US006653795B2

(12) United States Patent
Kang et al.

(10) Patent No.: US 6,653,795 B2
(45) Date of Patent: Nov. 25, 2003

(54) METHOD AND APPARATUS FOR DRIVING PLASMA DISPLAY PANEL USING SELECTIVE WRITING AND SELECTIVE ERASURE

(75) Inventors: Seong Ho Kang, Taegu (KR); Jang Hwan Cho, Kumi (JP); Gop Sick Kim, Kumi (JP); Eung Kwan Lee, Taegu (JP)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/803,993

(22) Filed: Mar. 13, 2001

(65) Prior Publication Data

US 2002/0033675 A1 Mar. 21, 2002

(30) Foreign Application Priority Data

| | | |
|---|---|---|
| Mar. 14, 2000 | (KR) | P00-12669 |
| Sep. 7, 2000 | (KR) | P00-53214 |
| Jan. 18, 2001 | (KR) | P01-3003 |
| Feb. 9, 2001 | (KR) | P01-6492 |

(51) Int. Cl.[7] ..... G09G 3/10; G09G 3/28
(52) U.S. Cl. ..... 315/169.3; 345/60
(58) Field of Search ..... 315/169.1, 169.2, 315/169.3; 345/76, 77, 82, 84, 55, 60, 63, 208, 204, 210, 214

(56) References Cited

U.S. PATENT DOCUMENTS

| | | | | |
|---|---|---|---|---|
| 5,663,741 A | * | 9/1997 | Kanazawa | 345/66 |
| 5,854,540 A | * | 12/1998 | Matsumoto et al. | 315/169.1 |
| 5,874,932 A | * | 2/1999 | Nagaoka et al. | 345/60 |
| 6,211,867 B1 | * | 4/2001 | Kim | 345/211 |
| 6,281,635 B1 | * | 8/2001 | Lee | 315/169.4 |
| 6,292,159 B1 | | 9/2001 | Someya et al. | 545/60 |
| 6,335,712 B1 | * | 1/2002 | Kim | 345/60 |
| 6,335,728 B1 | * | 1/2002 | Kida et al. | 345/204 |
| 6,344,841 B1 | * | 2/2002 | Moon | 345/60 |
| 6,356,249 B1 | * | 3/2002 | Lim | 345/66 |
| 6,362,800 B1 | * | 3/2002 | Moon | 345/60 |

FOREIGN PATENT DOCUMENTS

| | | |
|---|---|---|
| EP | 0834856 A | 4/1998 |
| FR | 2740253 A | 4/1997 |
| FR | 2755281 A | 4/1998 |

* cited by examiner

*Primary Examiner*—Don Wong
*Assistant Examiner*—Minh D A
(74) *Attorney, Agent, or Firm*—Fleshner & Kim, LLP

(57) ABSTRACT

A plasma display panel driving method and apparatus that is capable of driving a PDP at a high speed as well as improving the contrast. In the method, at least one selective writing sub-field is used to turn on discharge cells selected in an address interval. At least one selective erasing sub-field is used to turn off the discharge cells selected in the address interval. The selective writing sub-field and the selective erasing sub-field are arranged within one frame.

80 Claims, 16 Drawing Sheets

METHOD AND APPARATUS FOR DRIVING PLASMA DISPLAY PANEL USING SELECTIVE WRITING AND SELECTIVE ERASURE

BACKGROUND OF THE INVENTION

1. Field of the Invention

This invention relates to a technique for driving a plasma display panel, and more particularly to a plasma display panel driving method and apparatus that is capable of driving a plasma display panel at a higher speed as well as improving the contrast.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin-film and large-dimension type. Moreover, the PDP provides a very improved picture quality owing to a recent technical development. Particularly, a three-electrode, alternating current (AC) surface-discharge type PDP has advantages of a low-voltage driving and a long life in that it can lower a voltage required for a discharge using wall charges accumulated on the surface thereof during the discharge and protect the electrodes from a sputtering caused by the discharge.

Referring to FIG. 1, a discharge cell of the three-electrode, AC surface-discharge PDP includes a scanning/sustaining electrode 30Y and a common sustaining electrode 30Z formed on an upper substrate 10, and an address electrode 20X formed on a lower substrate 18.

The scanning/sustaining electrode 30Y and the common sustaining electrode 30Z include a transparent electrode 12Y or 12Z, and a metal bus electrode 13Y or 13Z having a smaller line width than the transparent electrode 12Y or 12Z and provided at one edge of the transparent electrode, respectively. The transparent electrodes 12Y and 12Z are formed from indium-tin-oxide (ITO) on the upper substrate 10. The metal bus electrodes 13Y and 13Z are formed from a metal such as chrome (Cr), etc. on the transparent electrodes 12Y and 12Z so as to reduce a voltage drop caused by the transparent electrodes 12Y and 12Z having a high resistance. On the upper substrate 10 provided with the scanning/sustaining electrode 30Y and the common sustaining electrode 30Z, an upper dielectric layer 14 and a protective film 16 are disposed. Wall charges generated upon plasma discharge are accumulated in the upper dielectric layer 14. The protective film 16 protects the upper dielectric layer 14 from a sputtering generated during the plasma discharge and improves the emission efficiency of secondary electrons. This protective film 16 is usually made from MgO. The address electrode 20X is formed in a direction crossing the scanning/sustaining electrode 30Y and the common sustaining electrode 30Z. A lower dielectric layer 22 and barrier ribs 24 are formed on the lower substrate 18 provided with the address electrode 20X. A fluorescent material layer 26 is coated on the surfaces of the lower dielectric layer 22 and the barrier ribs 24. The barrier ribs 24 are formed in parallel to the address electrode 20X to divide the discharge cell physically and prevent an ultraviolet ray and a visible light generated by the discharge from being leaked into the adjacent discharge cells. The fluorescent material layer 26 is excited and radiated by an ultraviolet ray generated upon plasma discharge to produce a red, green or blue color visible light ray. An inactive mixture gas, such as He+Xe or Ne+Xe, for a gas discharge is injected into a discharge space defined between the upper/lower substrate 10 and 18 and the barrier ribs 24.

Such a three-electrode AC surface-discharge PDP drives one frame, which is divided into various sub-fields having a different emission frequency, so as to realize gray levels of a picture. Each sub-field is again divided into a reset interval for uniformly causing a discharge, an address interval for selecting the discharge cell and a sustaining interval for realizing the gray levels depending on the discharge frequency. When it is intended to display a picture of 256 gray levels, a frame interval equal to 1/60 second (i.e. 16.67 msec) in each discharge cell 1 is divided into 8 sub-fields SF1 to SF8 as shown in FIG. 2. Each of the 8 sub-field SF1 to SF8 is divided into a reset interval, an address interval and a sustaining interval. The reset interval and the address interval of each sub-field are equal every sub-field, whereas the sustaining interval and the discharge frequency are increased at a ration of $2^n$ (wherein n=0, 1, 2, 3, 4, 5, 6 and 7) at each sub-field. Since the sustaining interval becomes different at each sub-field as mentioned above, the gray levels of a picture can be realized.

Such a PDP driving method is largely classified into a selective writing system and a selective erasing system depending on an emission of the discharge cell selected by the address discharge.

The selective writing system turns off the entire field in the reset interval and thereafter turns on the discharge cells selected by the address discharge. In the sustaining interval, a discharge of the discharge cells selected by the address discharge is sustained to display a picture.

In the selective writing system, a scanning pulse applied to the scanning/sustaining electrode 30Y has a pulse width set to 3 $\mu$s or more to form sufficient wall charges within the discharge-cell.

If the PDP has a resolution of VGA (video graphics array) class, it has total 480 scanning lines. Accordingly, in the selective writing system, an address interval within one frame requires total 11.52 ms when one frame interval (i.e., 16.67 ms) includes 8 sub-fields. On the other hand, a sustaining interval is assigned to 3.05 ms in consideration of a vertical synchronizing signal Vsync.

Herein, the address interval is calculated by 3 $\mu$s(a pulse width of the scanning pulse)×480 lines×8(the number of sub-fields) per frame. The sustaining interval is a time value (i.e., 16.67 ms−11.52 ms−0.3 ms−1 ms−0.8 ms) subtracting an address interval of 11.52 ms, once reset interval of 0.3 ms, and an extra time of the vertical synchronizing signal Vsync of 1 ms and an erasure interval of 100 $\mu$s×8 sub-fields from one frame interval of 16.67 ms.

The PDP may generate a pseudo contour noise from a moving picture because of its characteristic realizing the gray levels of the picture by a combination of sub-fields. If the pseudo contour noise is generated, then a pseudo contour emerges on the screen to deteriorate a picture display quality. For instance, if the screen is moved to the left after the left half of the screen was displayed by a gray level value of 128 and the right half of the screen was displayed by a gray level value of 127, a peak white, that is, a white stripe emerges at a boundary portion between the gray level values 127 and 128. To the contrary, if the screen is moved to the right after the left half thereof was displayed by a gray level value of 128 and the right half thereof was displayed by a gray level value of 127, then a black level, that is, a black stripe emerges on at a boundary portion between the gray level values 127 and 128.

In order to eliminate a pseudo contour noise of a moving picture, there has been suggested a scheme of dividing one sub-field to add one or two sub-fields, a scheme of re-arranging the sequence of sub-fields, a scheme of adding the sub-fields and re-arranging the sequence of sub-fields, and an error diffusion method, etc. However, in the selective writing system, the sustaining interval becomes insufficient or fails to be assigned if the sub-fields are added so as to eliminate a pseudo contour noise of a moving picture. For instance, in the selective writing system, two sub-fields of the 8 sub-fields are divided such that one frame includes 10 sub-fields, the display period, that is, the sustaining interval becomes absolutely insufficient. If one frame includes 10 sub-fields, the address interval becomes 14.4 ms, which is calculated by 3 $\mu$s(a pulse width of the scanning pulse)×480 lines×10(the number of sub-fields) per frame. On the other hand, the sustaining interval becomes −0.03 ms (i.e., 16.67 ms−14.4 ms−0.3 ms−1 ms−1 ms) which is a time value subtracting an address interval of 14.4 ms, once reset interval of 0.3 ms, an erasure interval of 100 $\mu$s×10 sub-fields and an extra time of the vertical synchronizing signal Vsync of 1 ms from one frame interval of 16.67 ms.

In such a selective writing system, a sustaining interval of about 3 ms can be assured when one frame consists of 8 sub-fields, whereas it becomes impossible to assure a time for the sustaining interval when one frame consists of 10 sub-fields. In order to overcome this problem, there has been suggested a scheme of divisionally driving one field. However, such a scheme raises another problem of a rise of manufacturing cost because it requires an addition of driver IC's.

A contrast characteristic of the selective writing system is as follows. In the selective writing system, when one frame consists of 8 sub-fields, a light of about 300 cd/m$^2$ corresponding to a brightness of the peak white is produced if a field continues to be turned on in the entire sustaining interval of 3.05 ms. On the other hand, if the field is sustained in a state of being turned on only in once reset interval and being turned off in the remaining interval within one frame, a light of about 0.7 cd/m$^2$ corresponding to the black is produced. Accordingly, a darkroom contrast ratio in the selective writing system has a level of 430:1.

The selective erasing system makes a writing discharge of the entire field in the reset interval and thereafter turns off the discharge cells selected in the address interval. Then, in the sustaining interval, only the discharge cells having not selected by the address discharge are sustaining-discharged to display a picture.

In the selective erasing system, a selective erasing data pulse with a pulse width of about 1 $\mu$s is applied to the address electrode 20X so that it can erase wall charges and space charges of the discharge cells selected during the address discharge. At the same time, a scanning pulse with a pulse width of 1 $\mu$s synchronized with the selective erasing data pulse is applied to the scanning/sustaining electrode 30Y.

In the selective writing system, if the PDP has a resolution of VGA (video graphics array) class, then an address interval within one frame requires only total 3.84 ms when one frame interval (i.e., 16.67 ms) consists of 8 sub-fields. On the other hand, a sustaining interval can be sufficiently assigned to about 10.73 ms in consideration of a vertical synchronizing signal Vsync. Herein, the address interval is calculated by 1 $\mu$s(a pulse width of the scanning pulse)×480 lines×8(the number of sub-fields) per frame. The sustaining interval is a time value (i.e., 16.67 ms−3.84 ms−0.3 ms−1 ms−0.8 ms) subtracting an address interval of 3.84 ms, once reset interval of 0.3 ms, and an extra time of the vertical synchronizing signal Vsync of 1 ms and an entire writing time of 100 $\mu$s×8 sub-fields from one frame interval of 16.67 ms. In such a selective erasing system, since the address interval is small, the sustaining interval as a display period can be assured even though the number of sub-fields is enlarged. If the number of sub-fields SF1 to SF10 within one frame is enlarged into ten as shown in FIG. 3, then the address interval becomes 4.8 ms calculated by 1 $\mu$s(a pulse width of the scanning pulse)−480 lines−10(the number of sub-fields) per frame. On the other hand, the sustaining interval becomes 9.57 ms which is a time value (i.e., 16.67 ms−4.8 ms−0.3 ms−1 ms−1 ms) subtracting an address interval of 4.8 ms, once reset interval of 0.3 ms, an extra time of the vertical synchronizing signal Vsync of 1 ms and the entire writing time of 100 $\mu$s×10 sub-fields from one frame interval of 16.67 ms. Accordingly, the selective erasing system can assure a sustaining interval three times longer than the above-mentioned selective writing system having 8 sub-fields even though the number of sub-fields is enlarged into ten, so that it can realize a bright picture with 256 gray levels.

However, the selective erasing system has a disadvantage of low contrast because the entire field is turned on in the entire writing interval.

In the selective erasing system, if the entire field continues to be turned on in the sustaining interval of 9.57 ms within one frame consisting of 10 sub-fields SF1 to SF10 as shown in FIG. 3, then a light of about 300 cd/m$^2$ corresponding to a brightness of the peak white is produced. A brightness corresponding to the black is 15.7 cd/m$^2$, which is a brightness value of 0.7 cd/M$^2$ generated in once reset interval plus 1.5 cd/M$^2$×10 sub-fields generated in the entire writing interval within one frame. Accordingly, since a darkroom contrast ratio in the selective erasing system is equal to a level of 950:15.7=60:1 when one frame consists of 10 sub-fields SF1 to SF10, the selective erasing system has a low contrast. As a result, a driving method using the selective erasing system provides a bright field owing to an assurance of sufficient sustaining interval, but fails to provide a clear field and a feeling of blurred picture due to a poor contrast.

In order to overcome a problem caused by such a poor contrast, there has been suggested a scheme of making an entire writing only once per frame and taking out the unnecessary discharge cells every sub-field SF1 to SF10. However, this scheme has a problem of poor picture quality in that next sub-field can not be driven until the previous sub-field has been turned on and thus the number of gray levels becomes merely the number of sub-fields plus one. In other words, if one frame includes 10 sub-fields, then the number of gray level become eleven as represented by the following table:

TABLE 1

| Gray level | SF1 (1) | SF2 (2) | SF3 (4) | SF4 (8) | SF5 (16) | SF6 (32) | SF7 (48) | SF8 (48) | SF9 (48) | SF10 (48) |
|---|---|---|---|---|---|---|---|---|---|---|
| 0 | x | x | x | x | x | x | x | x | x | x |
| 1 | | x | x | x | x | x | x | x | x | x |
| 3 | | | x | x | x | x | x | x | x | x |
| 7 | | | | x | x | x | x | x | x | x |
| 15 | | | | | x | x | x | x | x | x |
| 31 | | | | | | x | x | x | x | x |
| 63 | | | | | | | x | x | x | x |
| 111 | | | | | | | | x | x | x |
| 159 | | | | | | | | | x | x |
| 207 | | | | | | | | | | x |
| 255 | | | | | | | | | | |

In Table 1, 'SFx' means the x-numbered sub-field and '(y)' expresses a brightness weighting value set for the subject sub-field as a decimal number y. Further, '0' represents a state in which the subject sub-field is turned on while 'x' does a state in which the subject sub-field is turned off.

In Table 1, 'SFx' means the x-numbered sub-field and '(y)' expresses a brightness weighting value set for the subject sub-field as a decimal number y. Further, 'O' represents a state in which the subject sub-field is turned on while 'x' does a state in which the subject sub-field is turned off.

In this case, since only 1331 colors are expressed by all combination of red, green and blue colors, color expression ability becomes considerably insufficient in comparison to true colors of 16,700,000. The PDP adopting such a system has a darkroom contrast ratio of 430:1 by a peak white of 950 cd/m$^2$ when the entire field is turned on in the display interval of 9.57 ms and a black of 2.2 cd/m$^2$ which is a brightness value adding 0.7 cd/m$^2$ generated in once reset interval to 1.5 cd/m$^2$ generate in once entire writing interval.

As described above, in the conventional PDP driving method, the selective writing system fails to make a high-speed driving because each of a data pulse for selectively turning on the discharge cells in the address interval and a scanning pulse has a pulse width of 3 $\mu$s or more. The selective erasing system has an advantage of a higher speed driving than the selective writing system because each of a data pulse for selectively turning off the discharge cells and a scanning pulse is about 1 $\mu$s, whereas it has a disadvantage of a worse contrast than the selective writing system because the discharge cells in the entire field is turned on in the reset interval, that is, the non-display interval.

SUMMARY OF THE INVENTION

Accordingly, it is an object of the present invention to provide a PDP driving method and apparatus that is capable of driving a PDP at a high speed as well as improving the contrast.

A further object of the present invention is to provide a PDP driving method and apparatus that is suitable for running a selective writing system compatible with a selective erasing system.

In order to achieve these and other objects of the invention, a PDP driving method according to one aspect of the present invention includes the steps of turning on discharge cells selected in an address interval using at least one selective writing sub-field; and turning off the discharge cells selected in the address interval using at least one selective erasing sub-field, wherein the selective writing sub-field and the selective erasing sub-field are arranged within one frame.

A PDP driving method according to another aspect of the present invention includes the steps of expressing a gray level range using at least one selective writing sub-field by turning on selected discharge cells and maintaining a discharge of the turned-on cells; and expressing a high gray level range using at least one selective erasing sub-field by successively turning off the cells turned on in the previous sub-field.

A PDP driving method according to still another aspect of the present invention includes a kth frame including at least one selective writing sub-field for turning on the discharge cells selected in an address interval and at least one erasing sub-field for turning off the discharge cells selected in the address interval; and a (k+1)th frame including at least one selective writing sub-field for turning on the discharge cells selected in the address interval and at least one erasing sub-field for turning off the discharge cells selected in the address interval and having brightness weighting values of the sub-fields different from said kth frame, wherein k is a positive integer.

A driving apparatus for a plasma display panel according to still another aspect of the present invention includes a first electrode driver for applying a first scanning pulse for causing a writing discharge and a second scanning pulse for causing an erasure discharge to a first electrode of said panel in the address interval in accordance with a sub-field to drive the first electrode; and a second electrode driver for applying a first data for selecting the turned-on cells and a second data for selecting the turned-off cells to a second electrode of said panel in such a manner to be synchronized with the scanning pulses, thereby driving the second electrode.

The driving apparatus for a plasma display panel further includes a third electrode driver for applying a desired direct current voltage to a third electrode of said panel in the address interval and applying a sustaining pulse for causing a sustaining discharge of the discharge cells selected in the address interval to the third electrode to thereby drive the third electrode.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
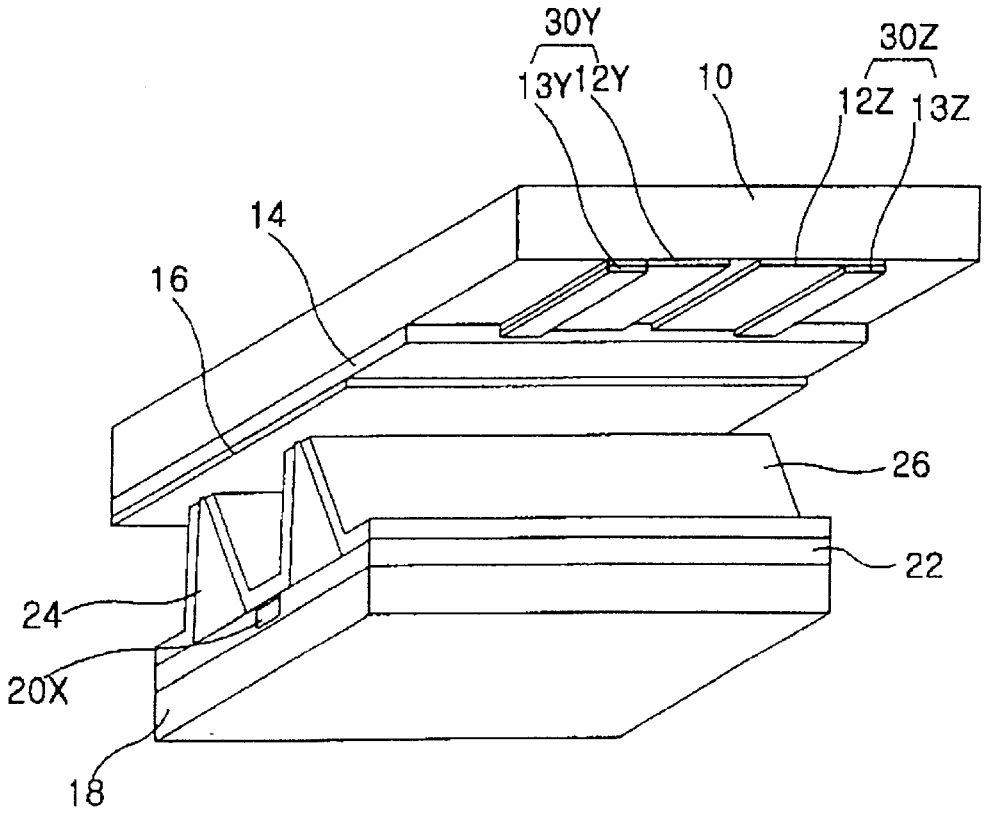
FIG. 1 CONVENTIONAL ART
FIG. 1 is a perspective view showing a discharge cell structure of a conventional three-electrode AC surface-discharge plasma display panel.
Figure 2:
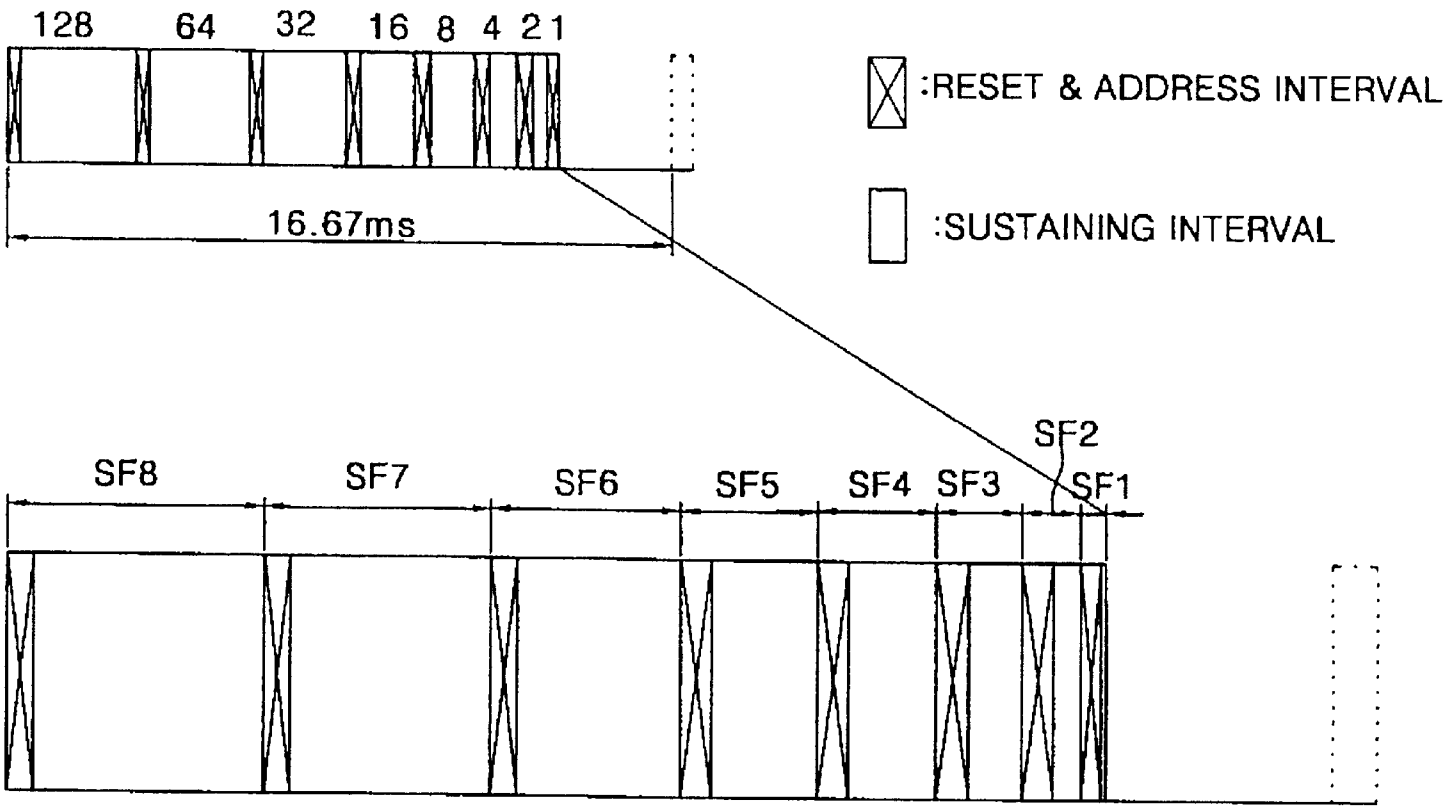
FIG.2 CONVENTIONAL ART
FIG. 2 illustrates a conventional configuration of one frame including 8 sub-fields in a conventional PDP driving method.
Figure 3:
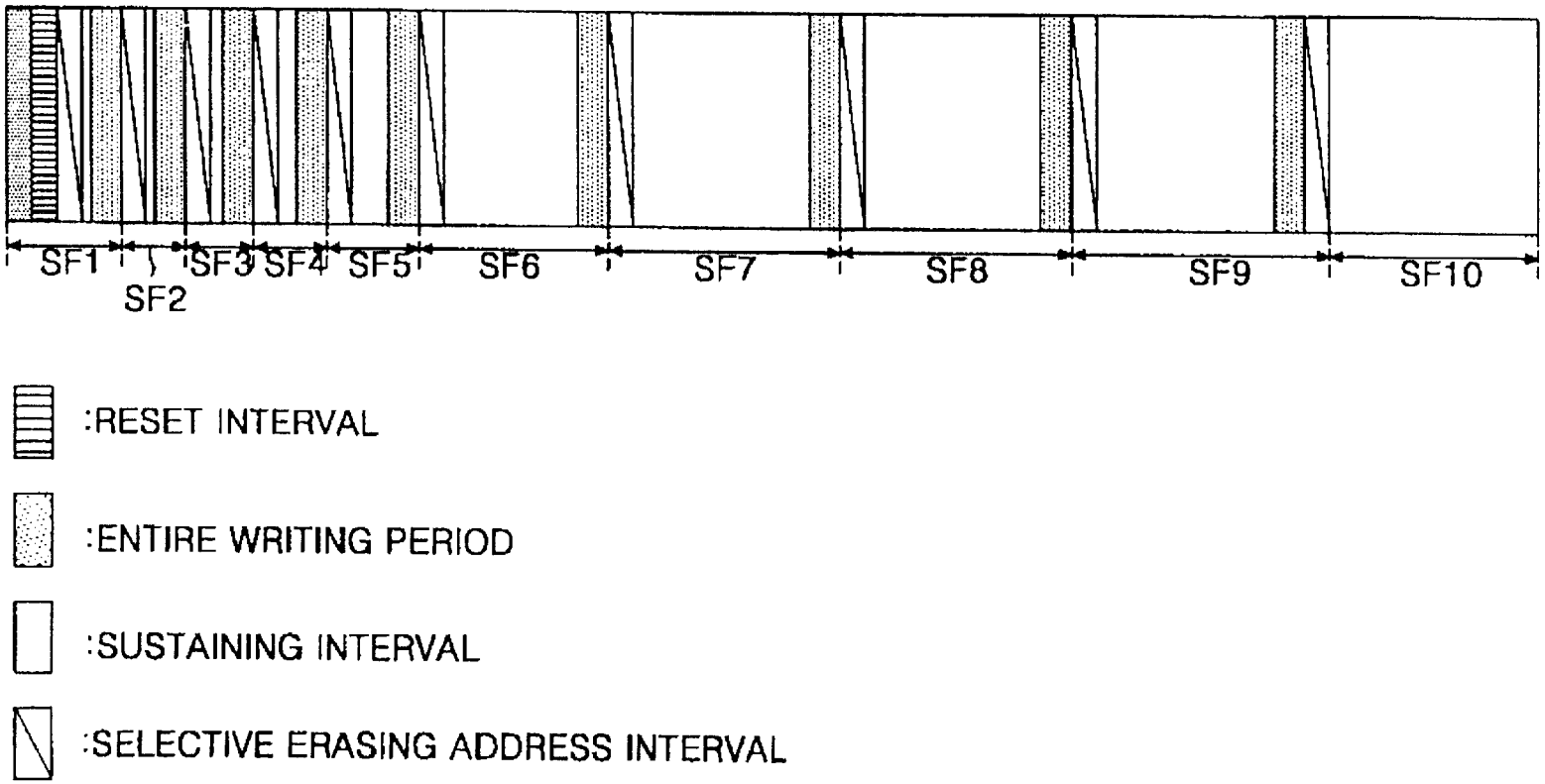
FIG.3 CONVENTIONAL ART
FIG. 3 illustrates a configuration of one frame including 10 sub-fields and preceding an entire writing discharge every sub-field in a conventional PDP driving method.
Figure 4:
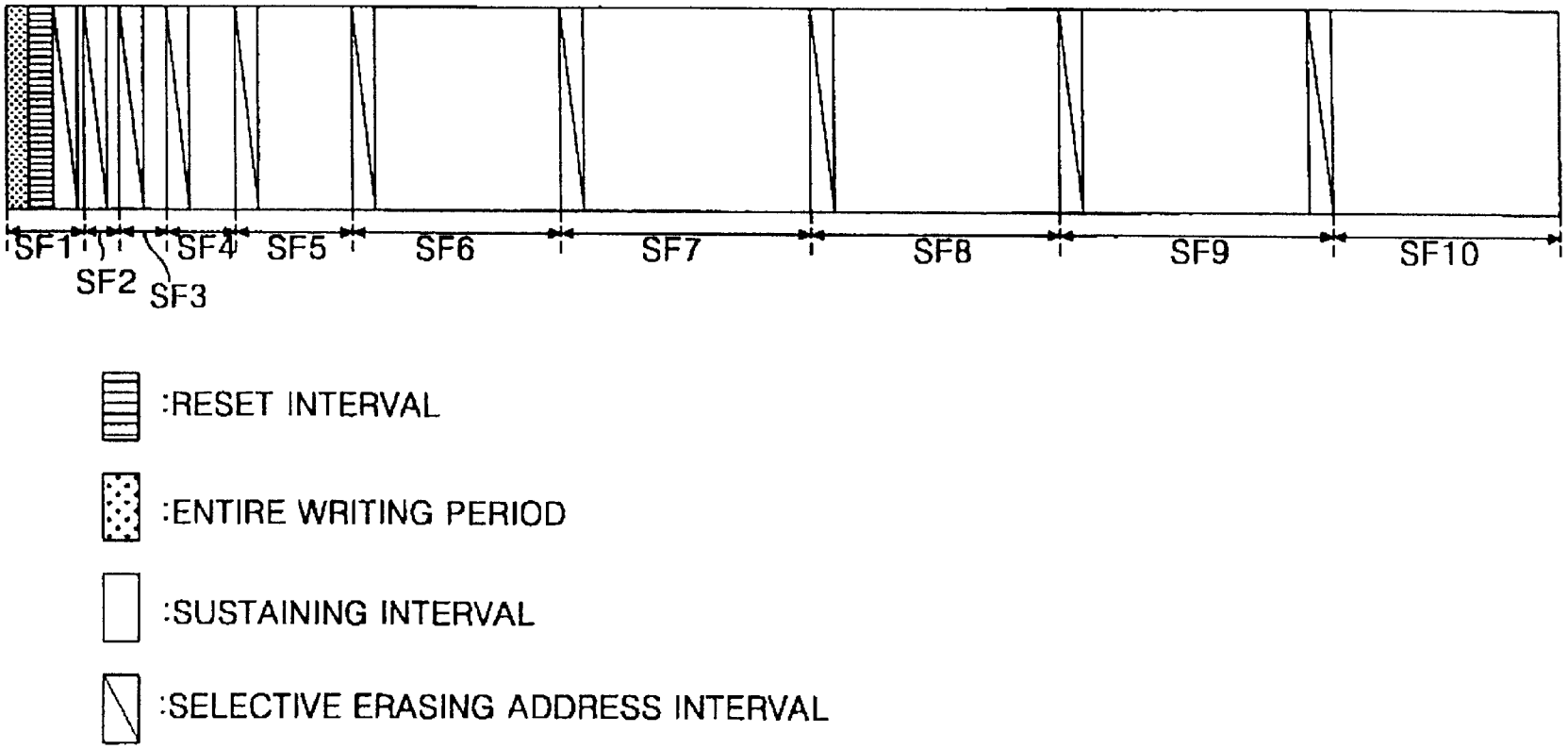
FIG. 4 CONVENTIONAL ART
FIG. 4 illustrates a configuration of one frame including 10 sub-fields and once entire writing discharge in a conventional PDP driving method.
Figure 5:
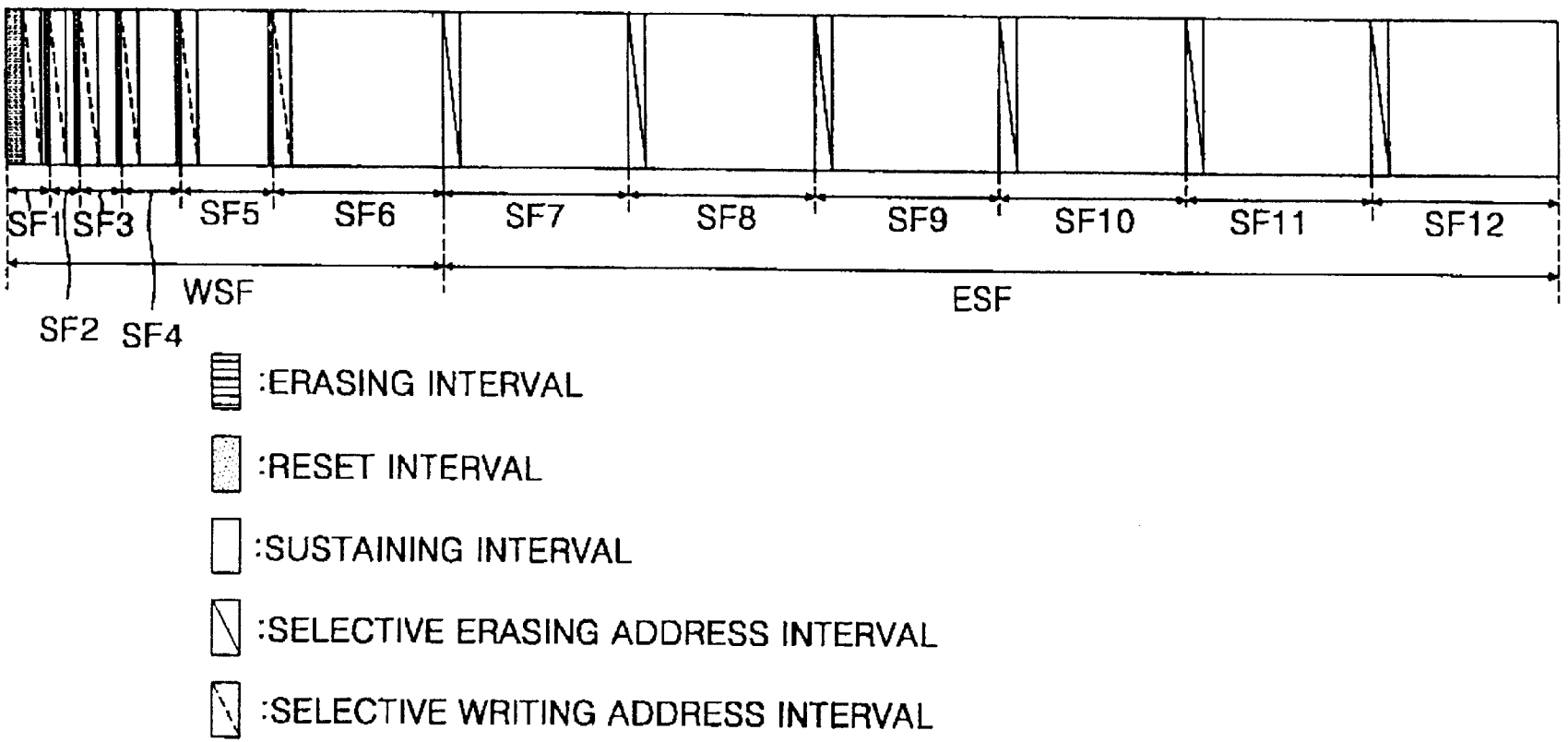
FIG. 5 illustrates a configuration of one frame in a PDP driving method according to a first embodiment of the present invention.

FIG. 5 shows a configuration of one frame in a PDP driving method according to a first embodiment of the present invention. In FIG. 5, one frame includes selective writing sub-field WSF and selective erasing sub-field ESF.

The selective writing sub-field WSF includes first to sixth sub-fields SF1 to SF6. The first sub-field SF1 is divided into a selective writing address interval following a reset interval turning off the entire field and turning on the selected discharge cells, a sustaining interval causing a sustaining discharge for the discharge cell selected by the address discharge, and an erasure interval erasing the sustaining discharge. Each of the second to fifth sub-fields SE2 to SF5 has no reset interval and is divided into a selective writing address interval, a sustaining interval and an erasure interval. The sixth sub-field SF6 does not have a reset interval and an erasure interval and is divided into a selective writing address interval and a sustaining interval. In the first to sixth sub-fields SF1 to SF6, the selective writing address interval and the erasure interval are equal to each other every sub-field, whereas the sustaining interval and the discharge frequency are increased at a ratio of $2^0$, $2^1$, $2^2$, $2^3$, $2^4$ or $2^5$.

The selective erasing sub-field ESF further includes the seventh to twelfth sub-fields SF7 to SF12. The seventh to twelfth sub-fields SF7 to SF12 do not have an entire writing period at which the entire field is written. Each of the seventh to twelfth sub-fields SF7 to SF12 is divided into a selective erasing address interval for turning off the selected discharge cells and a sustaining interval for causing a sustaining discharge with respect to discharge cells other than the discharge cells selected by the address discharge. In the seventh to twelfth sub-fields SF7 to SF12, the selective erasing address intervals as well as the sustaining intervals are set to be equal. Each sustaining interval of the seventh to twelfth sub-fields SF7 to SF12 are assigned to have the same relative brightness ratio as the sixth sub-field SF6.

Gray levels and coding methods expressed by the first to twelfth sub-fields SF1 to SF12 are indicated in the following table:

TABLE 2

| Gray level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0 31 | | Binary Coding | | | | x | x | x | x | x | x | x |
| 32 63 | | Binary Coding | | | | | x | x | x | x | x | x |
| 64 95 | | Binary Coding | | | | | | x | x | x | x | x |
| 96 127 | | Binary Coding | | | | | | | x | x | x | x |
| 128 159 | | Binary Coding | | | | | | | | x | x | x |
| 160 191 | | Binary Coding | | | | | | | | | x | x |
| 192 223 | | Binary Coding | | | | | | | | | | x |
| 224 255 | | Binary Coding | | | | | | | | | | |

As can be seen from Table 2, the first to fifth sub-fields SF1 to SF5 arranged at the front side of the frame express gray level values by the binary coding. On the other hand, the sixth to twelfth sub-fields SF6 to SF12 express gray level values larger than a desired value by the linear coding. For instance, the gray level value '11' is expressed by a binary code combination by turning on the first sub-field SF1, the second sub-field SF2 and the fourth sub-field SF4 having relative brightness ratios of 1, 2 and 8, respectively while turning off the remaining sub-fields. Comparatively, the gray level value '74' is expressed by turning on the second and fourth sub-fields SF2 and SF4 by a binary code combination and turning on the sixth and seventh sub-fields SF6 and SF7 by a linear code combination while turning off the remaining sub-fields.

Each of the seventh to twelfth sub-fields SF7 to SF12 which are the selective erasing sub-field ESF must always be in a state of turning on the last sub-field or the previous sub-field of the selective writing sub-field WSF so that it can turn off the unnecessary discharge cells whenever it is shift to the next sub-field. In other words, the last sub-field of the selective writing sub-field WSF, i.e., the sixth sub-field SF6 must be turned on in order to turn on the seventh sub-field SF7, whereas there are discharge cells turned on in the seventh sub-field SF7 in order to turn on the eighth sub-field SF1.

After the sixth sub-field SF6 was turned on, the seventh to twelfth sub-fields SF7 to SF12 which are the selective erasing sub-field WSF goes to turn off the necessary discharge cells in the discharge cells having been turned on in the previous sub-field. To this end, the cells turned on in the last selective writing sub-field WSF, i.e., the sixth sub-field SF6 must be maintained in a state of being turned on by the sustaining discharge so as to use the selective erasing sub-field ESF. Thus, the seventh sub-field SF7 does not require an individual writing discharge for a selective erasure addressing. The eighth to twelfth sub-fields SF1 to SF12 also selectively turn off the cells having been turned on in the previous sub-field with no entire writing.

A pulse width of the selective writing scanning pulse −SWSCN is not limited to 3 μs, but can be selected into a range of 2 to 3 μs. A pulse width of the selective erasing scanning pulse −SESCN can be selected within 1 μs or into a range of 1 to 2 μs.

If one frame includes the selective writing sub-field WSF and the selective erasing sub-field ESF, the address interval requires total 11.52 ms when a PDP has a VGA class resolution, that is, 480 scanning lines. On the other hand, the sustaining interval requires 3.35 ms. Herein, the address interval is a sum of 8.64 ms calculated by 3 μs(a pulse width of the selective writing scanning pulse)×480 lines×6(the number of selective writing sub-fields) per frame and 2.88 ms calculated by 1 μs(a pulse width of the selective erasing scanning pulse)×480 lines×6(the number of selective scanning sub-fields) per frame. The sustaining interval is a value (16.67 ms−8.64 ms−2.88 ms−0.3 ms−1 ms−1 ms) subtracting an address interval of 11.52 ms, once reset interval of 0.3 ms, an extra time of the vertical synchronizing signal Vsync of 1 ms and an erasing period of 100 μs×5(the number of sub-fields)=0.5 ms from one frame interval of 16.67 ms.

Accordingly, the present PDP driving method can enlarge the number of sub-fields in comparison to the conventional selective writing system to reduce a pseudo contour noise in a moving picture. Also, the present PDP driving method can more assure the sustaining interval from 3.05 ms into 3.35 ms in comparison to a case where one frame includes 8 sub-fields in the conventional selective writing system.

When one frame includes the selective writing sub-field WSF and the selective erasing sub-field ESF, then a light of about 330 cd/m$^2$ corresponding to a brightness of the peak white is produced if the entire field continues to be turned on in the sustaining interval of 3.35 ms. On the other hand, if the field is turned on only in once reset interval within one frame, a light of about 0.7 cd/m$^2$ corresponding to the black is produced.

Accordingly, a darkroom contrast ratio in the present PDP driving method becomes a level of 430:1, it can be improved in comparison to a contrast ratio (i.e., 60:1) in the conventional selective erasing system including 10 sub-fields within one frame. Furthermore, a contrast in the present PDP driving method is more increased than a contrast (i.e., 430:1) in the conventional selective writing system including 8 sub-fields within one frame.

Figure 6:
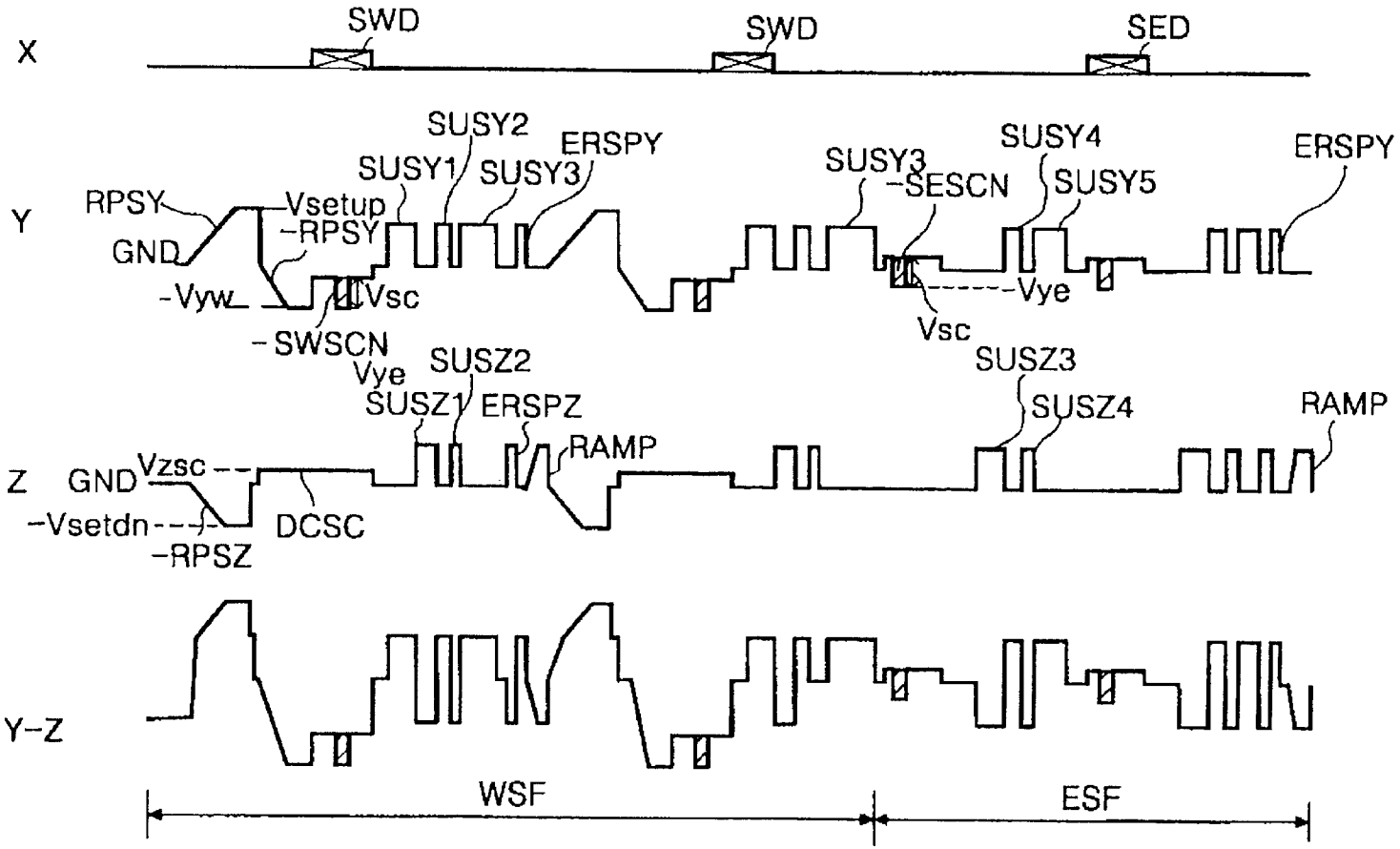
FIG. 6 is a waveform diagram of driving signals in the PDP driving method according to the first embodiment of the present invention.

FIG. 6 shows driving waveforms in the PDP driving method according to a first embodiment of the present invention.

Referring to FIG. 6, a setup waveform RPSY, which is a ramp waveform having a rising slope, is applied to the scanning/sustaining electrode lines Y in the reset interval of the selective writing sub-field WSF and, at the same time, a setdown waveform −RPSZ, which is a ramp waveform having a falling slope, is applied to the common sustaining electrode lines Z. Also, a setdown waveform −PRSY followed by the setup waveform RPSY, which is a ramp waveform having a falling slope, is applied to the scanning/sustaining electrode lines Y and a positive scanning direct current voltage DCSC is applied to the common sustaining electrode lines Z.

In the address interval of the selective writing sub-field WSF, a negative writing scanning pulse −SWSCN and a positive writing data pulse SWD are applied to the scanning/sustaining electrode lines Y and the address electrode lines X, respectively in such a manner to be synchronized with each other. The discharge cells selected by the writing scanning pulse −SWSCN and the writing data pulse SWD accumulate wall charges and space charges upon address discharging. In this interval, a positive scanning direct current voltage DCSC continues to be applied to the common sustaining electrode lines Z.

In the sustaining interval of the selective writing sub-field WSF, sustaining pulses SUSY and SUSZ are alternately applied to the scanning/sustaining electrode lines Y and the common sustaining electrode lines Z. The sustaining pulses SUSY and SUSZ allow the discharge cells having been turned on by the address discharge to maintain a discharge. Discharge cells other than the discharge cells selected by the address discharge do not generate an address discharge. This is because the discharge cells having not generated the address discharge do not have sufficient wall charges and space charges, to cause no discharge even when the sustaining pulses SUSY and SUSZ are applied thereto.

At an end time of the selective writing sub-field WSF, a ramp signal RAMP having a low voltage level is applied to the common sustaining electrode lines Z after a small-width erasing pulse ERSPY for erasing the sustaining discharge was applied to the scanning/sustaining electrode lines Y.

In the last selective writing sub-field WSF, i.e., the sixth sub-field SF6 followed by the selective erasing sub-field ESF, the erasing pulse ERSPY and the ramp signal RAMP for erasing the sustaining discharge is not applied. Instead, the last sustaining pulses of the last selective writing sub-field WSF followed by the selective erasing sub-field ESF and the selective erasing sub-field WSF followed by the selective erasing sub-field ESF are applied to the scanning/sustaining electrode lines Y at a relatively large pulse width. These last pulses play a role to write the next selective erasing sub-field ESF.

A pulse SUSY1 for initiating the sustaining discharge and the last pulse SUSY3 for writing the following selective erasing sub-field ESF in the sustaining pulses SUSY and SUSZ are set to has a larger pulse width than the normal sustaining pulse so that a stable discharge can be generated.

In the address interval of the selective erasing sub-field ESF, a negative erasing scanning pulse −SESCN and a positive erasing data pulse SED for erasing a discharge within the discharge cell are applied to the scanning/sustaining electrode lines Y and the address electrode lines X, respectively in such a manner to be synchronized with each other. The cells selected by the erasing scanning pulse −SESCN and the erasing data pulse SED cause a weak discharge to erase wall charges and space charges.

In the sustaining interval of the selective erasing sub-field ESF, the sustaining pulses SUSY and SUSZ are alternately to the scanning/sustaining electrode lines Y and the common sustaining electrode lines Z. Owing to these sustaining pulses SUSY and SUSZ, a discharge of the discharge cells which is not turned off by the address discharge is sustained to keep a turn-on state. The discharge cells having been turned off by the address discharge does not generate a discharge even when the sustaining pulses SUSY and SUSZ are applied thereto because they have insufficient amounts of wall charges and space charges.

At an end time of the last selective erasing sub-field, i.e., the twelfth sub-field SF12 followed by the selective writing sub-field WSF, the erasing pulse ERSPY and the ramp signal RAMP are applied to the scanning/sustaining electrode lines Y and the common sustaining electrode lines Z to erase a discharge of the turned-on cells.

A pulse SUSY1 for initiating the sustaining discharge and the last pulse SUSY3 for writing the following selective erasing sub-field ESF in the sustaining pulses SUSY and SUSZ are set to has a larger pulse width than the normal sustaining pulse so that a stable discharge can be generated.

Figure 7:
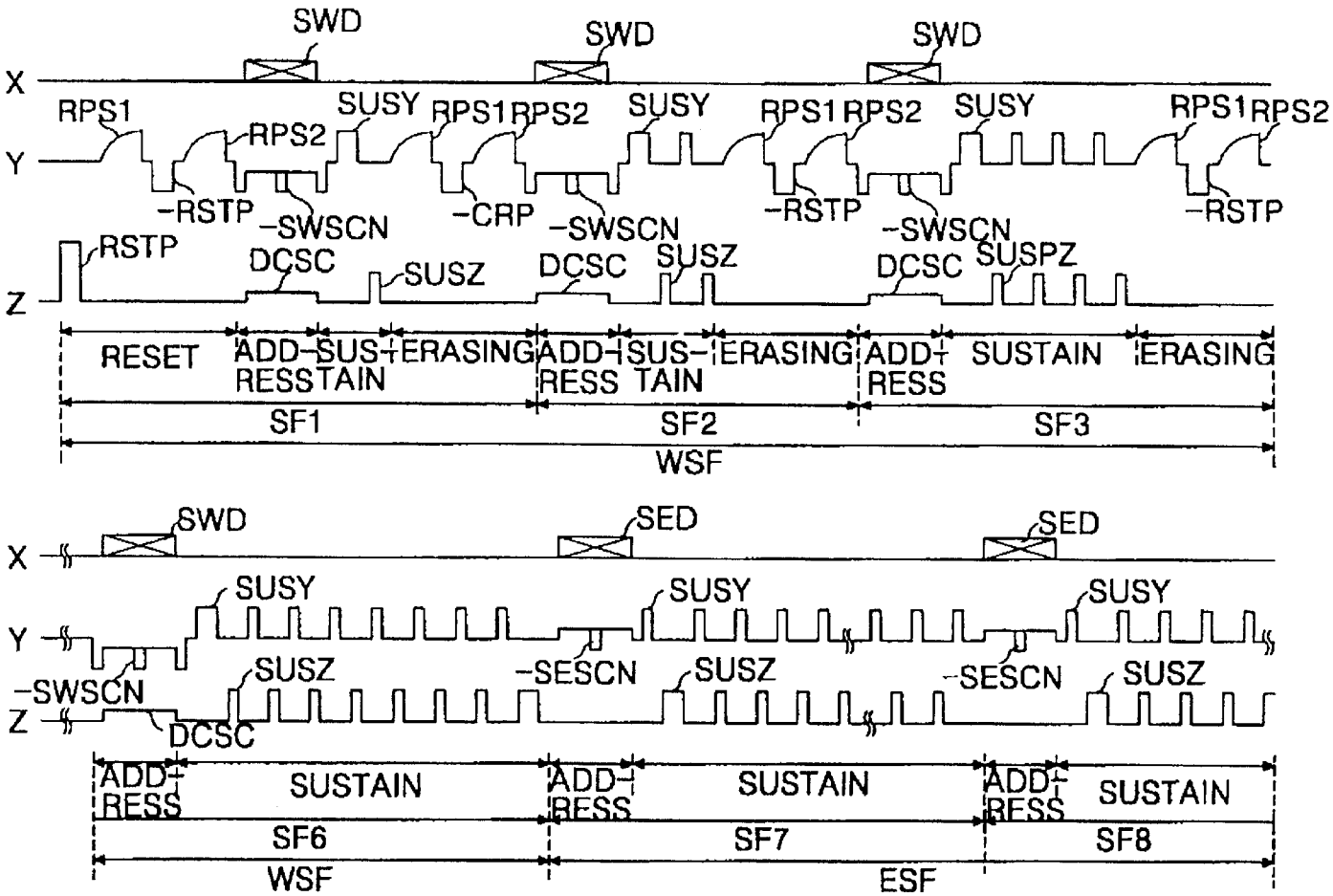
FIG. 7 is a waveform diagram of another driving signals in a selective writing sub-field and a selective erasing sub-field according to the first embodiment of the present invention.

FIG. 7 shows another driving waveforms of the selective writing sub-field and the selective erasing sub-field in the PDP driving method according to a first embodiment of the present invention.

Referring to FIG. 7, the selective writing sub-field WSF includes an address interval, a sustaining interval and an erasure interval while the selective erasing sub-field WSF includes an address interval and a sustaining interval.

The first sub-field SF1 of the selective writing sub-field WSF causes a writing discharge at the discharge cells of the entire field to be preceded by a reset interval for initializing the entire field. To this end, a relatively large, positive reset pulse RSTP is applied to the common sustaining electrode lines Z in the reset interval of the first sub-field SF1. A first setup waveform RPS1 having a rising slope is applied to the scanning/sustaining electrode lines Y, and there after a negative pulse −RSTP and a second setup waveform RPS2 having a rising slope is applied thereto. Then, the discharge cells of the entire field conduct discharge, sustaining and erasure processes to uniform a wall charge amount at the interior thereof and erase electric charges unnecessary for the discharge.

In the address interval of the selective writing sub-field WSF, a negative writing scanning pulse −SWSCN and a positive writing data pulse SWD are applied to the scanning/sustaining electrode lines Y and the address electrode lines X, respectively in such a manner to be synchronized with each other. Then, the selected discharge cells accumulate wall charges and space charges by the address discharge. In this interval, a positive scanning direct current voltage DCSC continues to be applied to the common sustaining electrode lines Z.

In the sustaining interval of the selective writing sub-field WSF, sustaining pulses SUSY and SUSZ are alternately applied to the scanning/sustaining electrode lines Y and the common sustaining electrode lines Z. The sustaining pulses SUSY and SUSZ allow the discharge cells having been turned on by the address discharge to maintain a discharge. Discharge cells other than the discharge cells selected by the address discharge do not generate a sustaining discharge.

In the erasure interval of the selective writing sub-field WSF, a first setup waveform RPS1, a negative pulse −RSTP and a second setup waveform RPS2 are applied to the scanning/sustaining electrode lines Y. Then, the discharge cells of the entire field conduct discharge, sustaining and erasure processes to uniform a wall charge amount at the interior thereof.

In the address interval of the selective erasing sub-field ESF, a negative erasing scanning pulse −SESCN and a positive erasing data pulse SED for turning off the discharge cell having been turned on in the previous sub-field are applied to the scanning/sustaining electrode lines Y and the address electrode lines X, respectively in such a manner to be synchronized with each other. The cells selected by the erasing scanning pulse −SESCN and the erasing data pulse SED cause a weak discharge to erase wall charges and space charges.

In the sustaining interval of the selective erasing sub-field ESF, the sustaining pulses SUSY and SUSZ are alternately to the scanning/sustaining electrode lines Y and the common sustaining electrode lines Z. Owing to these sustaining pulses SUSY and SUSZ, a discharge of the discharge cells which is not turned off by the address discharge is sustained to keep a turn-on state.

Figure 8:
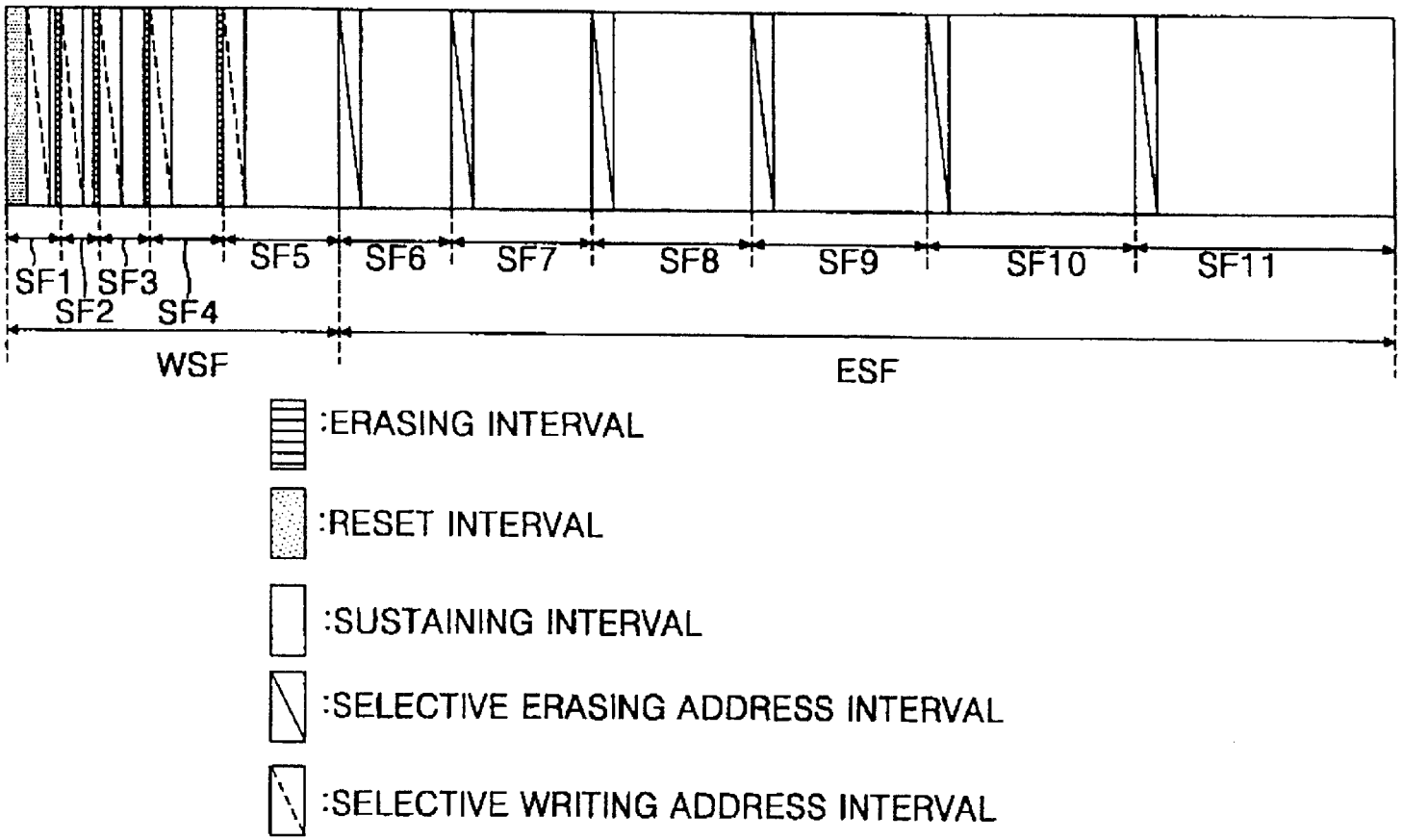
FIG. 8 illustrates a configuration of one frame in a PDP driving method according to a second embodiment of the present invention.

FIG. 8 shows a configuration of one frame in a PDP driving method according to a second embodiment of the present invention. In FIG. 8, one frame includes a selective writing sub-field WSF having 5 sub-fields SF1 to SF5 for expressing a low gray level value and a selective erasing sub-field ESF having 6 sub-fields SF6 to SF11 for expressing a high gray level value.

The first sub-field SF1 is divided into a reset interval for turning off the entire field, a selective writing address interval for turning on the selected discharge cells, a sustaining interval for causing a sustaining discharge for the selected discharge cells, and an erasure interval for erasing the sustaining discharge. Each of the second to fourth sub-fields SE2 to SF4 is divided into a selective writing address interval, a sustaining interval and an erasure interval. The fifth sub-field SF5 is divided into a selective writing address interval and a sustaining interval. In the first to fifth sub-fields SF1 to SF5, the selective writing address interval and the erasure interval are equal to each other every sub-field, whereas the sustaining interval and the discharge frequency is increased at a ratio of $2^0$, $2^1$, $2^2$, $2^3$, $2^4$ or $2^5$.

The sixth to eleventh sub-fields SF6 to SF11 do not have an entire writing period at which the entire field is written. Each of the sixth to eleventh sub-fields SF6 to SF11 is divided into a selective erasing address interval for turning off the selected discharge cells and a sustaining interval for causing a sustaining discharge with respect to discharge cells other than the discharge cells selected by the address discharge. In the sixth to eleventh sub-fields SF6 to SF11, the selective erasing address intervals as well as the sustaining intervals are set to be equal.

Gray levels and coding methods expressed by the first to eleventh sub-fields SF1 to SF11 are indicated in the following table:

TABLE 3

| Gray level | SF1 (1) | SF2 (2) | SF3 (4) | SF4 (8) | SF5 (16) | SF6 (16) | SF7 (24) | SF8 (32) | SF9 (40) | SF10 (50) | SF11 (62) |
|---|---|---|---|---|---|---|---|---|---|---|---|
| 0 15 | | Binary Coding | | | x | x | x | x | x | x | x |
| 16 31 | | Binary Coding | | | | x | x | x | x | x | x |
| 32 47 | | Binary Coding | | | | | x | x | x | x | x |
| 56 71 | | Binary Coding | | | | | | x | x | x | x |
| 88 103 | | Binary Coding | | | | | | | x | x | x |
| 128 143 | | Binary Coding | | | | | | | | x | x |
| 178 193 | | Binary Coding | | | | | | | | | x |
| 240 255 | | Binary Coding | | | | | | | | | |

As can be seen from Table 3, the first to fourth sub-fields SF1 to SF4 arranged at the front side of the frame express gray level values by the binary coding. On the other hand, the fifth to eleventh sub-fields SF5 to SF11 express gray level values larger than a desired value by the linear coding. For instance, the gray level value '11' is expressed by a binary code combination by turning on the first sub-field SF1, the second sub-field SF2 and the fourth sub-field SF4 having relative brightness ratios of 1, 2 and 8, respectively while turning off the remaining sub-fields. Comparatively, the gray level value '42' is expressed by turning on the second and fourth sub-fields SF2 and SF4 by a binary code combination and turning on the fifth and sixth sub-fields SF5 and SF6 by a linear code combination while turning off the remaining sub-fields.

As seen from Table 3, the PDP driving method according to the second embodiment does not express a portion of gray level values. In other words, all the gray level values of 0 to 47 can be expressed, but a gray level range of 48 to 55, 72 to 87, 104 to 127, 144 to 128 and 194 to 239 cannot be expressed by binary code combinations and linear code combinations in Table 3. The unexpressed gray level range can be corrected in similarity to gray level values to be expressed using a Dithering or an error diffusion technique. If a portion of gray level range in such high gray levels is displayed by the Dithering or the error diffusion technique, then a picture quality is slightly deteriorated, but the deterioration extent thereof can be minimized.

Each of the sixth to eleventh sub-fields SF6 to SF11 which are the selective erasing sub-field ESF must always be in a state of turning on the last sub-field or the previous sub-field of the selective writing sub-field WSF so that it can turn off the unnecessary discharge cells whenever it is shift to the next sub-field. In other words, the last sub-field of the selective writing sub-field WSF, i.e., the fifth sub-field SF5 must be turned on in order to turn on the sixth sub-field SF6, whereas there are discharge cells turned on in the fifth sub-field SF5 in order to turn on the seventh sub-field SF7.

After the fifth sub-field SF5 was turned on, the sixth to eleventh sub-fields SF6 to SF11 which are the selective erasing sub-field WSF successively turn off the necessary discharge cells in the discharge cells having been turned on in the previous sub-field. To this end, the cells turned on in the last selective writing sub-field WSF, i.e., the fifth sub-field SF5 must maintain a turn-on state by the sustaining discharge so as to use the selective erasing sub-fields ESF. Thus, the sixth sub-field SF6 does not require an individual writing discharge for a selective erasure addressing. Likewise, the seventh to eleventh sub-fields SF7 to SF11 selectively turn off the cells having been turned on in the previous sub-field with no entire writing.

If one frame includes 5 sub-fields SF1 to SF5 driven by the selective writing system and 6 sub-fields SF6 to SF11 driven by the selective erasing system, an address interval is more reduced.

When a PDP has a VGA class resolution, a time required for an address interval is merely 10.08 ms. As the address interval is more reduced, the sustaining interval can be sufficiently assured into 4.89 ms. Herein, the address interval is a sum of 7.2 ms calculated by 3 $\mu$s(a pulse width of the selective writing scanning pulse)×480 lines×5(the number of selective writing sub-fields) per frame and 2.88 ms calculated by 1 $\mu$s(a pulse width of the selective erasing scanning pulse)×480 lines×6(the number of selective scanning sub-fields) per frame. The sustaining interval is a value (16.67 ms−10.8 ms−0.3 ms−1 ms−0.5 ms) subtracting an address interval of 10.08 ms, once reset interval of 0.3 ms, an extra time of the vertical synchronizing signal Vsync of 1 ms and an erasing period of 100 $\mu$s×4(the number of sub-fields)=0.4 ms from one frame interval of 16.67 ms.

If the entire field is turned on in the sustaining interval of 4.89 ms, a light of about 490 cd/m$^2$ corresponding to a brightness of the peak white is produced. On the other hand, if the field is turned on only in once reset interval within one frame, a light of about 0.7 cd/m$^2$ corresponding to the black is produced. Accordingly, a darkroom contrast ratio in the PDP driving method according to the second embodiment becomes a level of 700:1.

Figure 9:
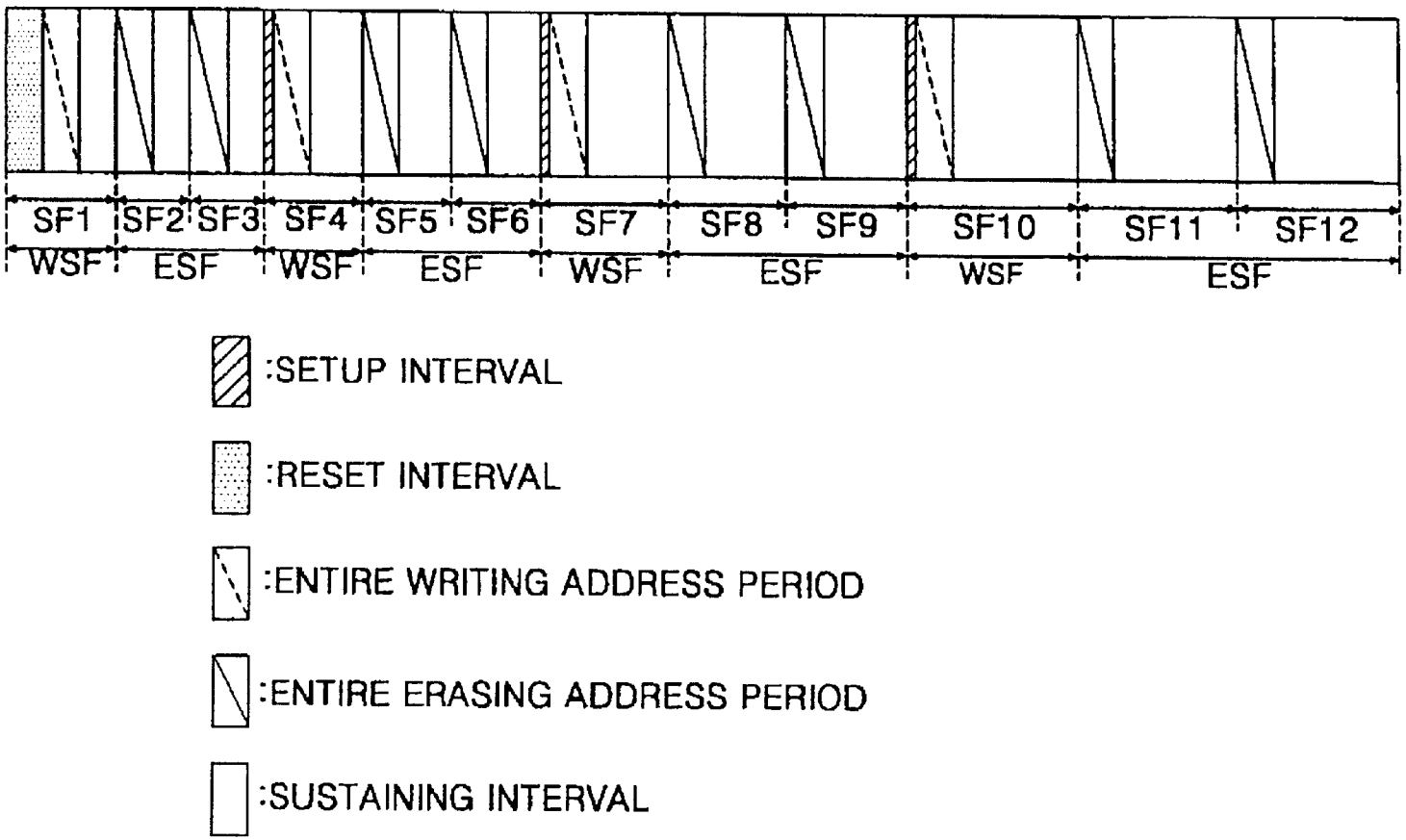
FIG. 9 illustrates a configuration of one frame in a PDP driving method according to a third embodiment of the present invention.

FIG. 9 shows a configuration of one frame in a PDP driving method according to a third embodiment of the present invention. In FIG. 8, one frame includes selective writing sub-fields WSF and selective erasing sub-fields ESF which are periodically alternate.

The selective writing sub-fields WSF include the first sub-field SF1, the fourth sub-field SF4, the seventh sub-field SF7 and the tenth sub-field SF10. The selective erasing sub-fields ESF include the second and fourth sub-fields SF2 and SF3 arranged between the first and fourth sub-fields SF1 to SF4, the fifth and sixth sub-fields SF5 and SF6 arranged between the fourth and seventh sub-fields SF4 and SF7, the eighth and ninth sub-fields SF1 and SF9 arranged between the seventh and tenth sub-fields SF7 and SF10, and the eleventh and twelfth sub-fields SF11 and SF12 following the tenth sub-field SF10. Accordingly, one frame includes 12 sub-fields SF1 to SF12 and has the selective writing sub-fields WSF and the selective erasing sub-fields ESF which are alternately arranged. The number of selective erasing sub-fields ESF arranged between the selective writing sub-fields WSF may be controlled.

The first sub-field SF1 is divided into a reset interval for turning off the entire field, a selective writing address interval for turning on the selected discharge cells and a sustaining interval for causing a sustaining discharge for the selected discharge cells. Each of the fourth sub-field SF4, the seventh sub-field SF7 and the tenth sub-field SF10 is a setup interval, the address interval and the sustaining interval. These selective writing sub-fields WSF do not include an individual erasing interval for erasing the sustaining discharge.

In the selective writing sub-fields WSF, the selective writing address intervals are equal to each other every sub-field, whereas the sustaining interval and the discharge frequency are increased at a ratio of $2^n$ (wherein n=0, 2, 4 or 6) every sub-field.

The selective erasing sub-fields ESF do not have an entire writing period at which the entire field is written. Each of the selective erasing sub-fields ESF is divided into a selective erasing address interval for turning off the selected discharge cells and a sustaining interval for causing a sustaining discharge with respect to discharge cells other than the discharge cells selected by the address discharge. In the selective erasing sub-fields ESF, the selective erasing address intervals are set to be equal, whereas the sustaining interval and the discharge frequency are increased at a ratio of $2^0$, $2^0$; $2^2$, $2^2$; $2^4$, $2^4$ or $2^6$, $2^6$.

Figure 10A:
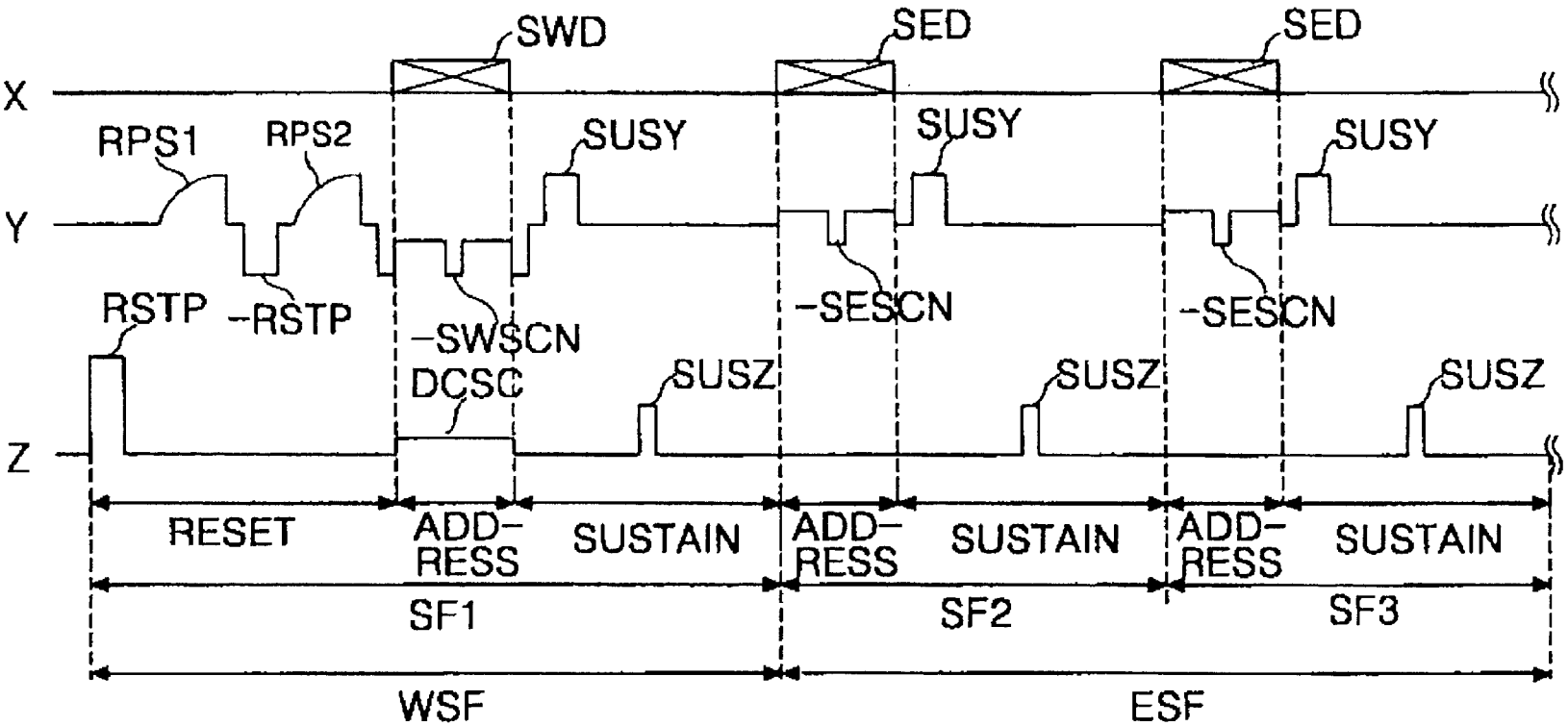
FIG. 10A and FIG. 10B illustrate waveform diagrams of driving signals in the PDP driving method according to the third embodiment of the present invention.
Figure 10B:
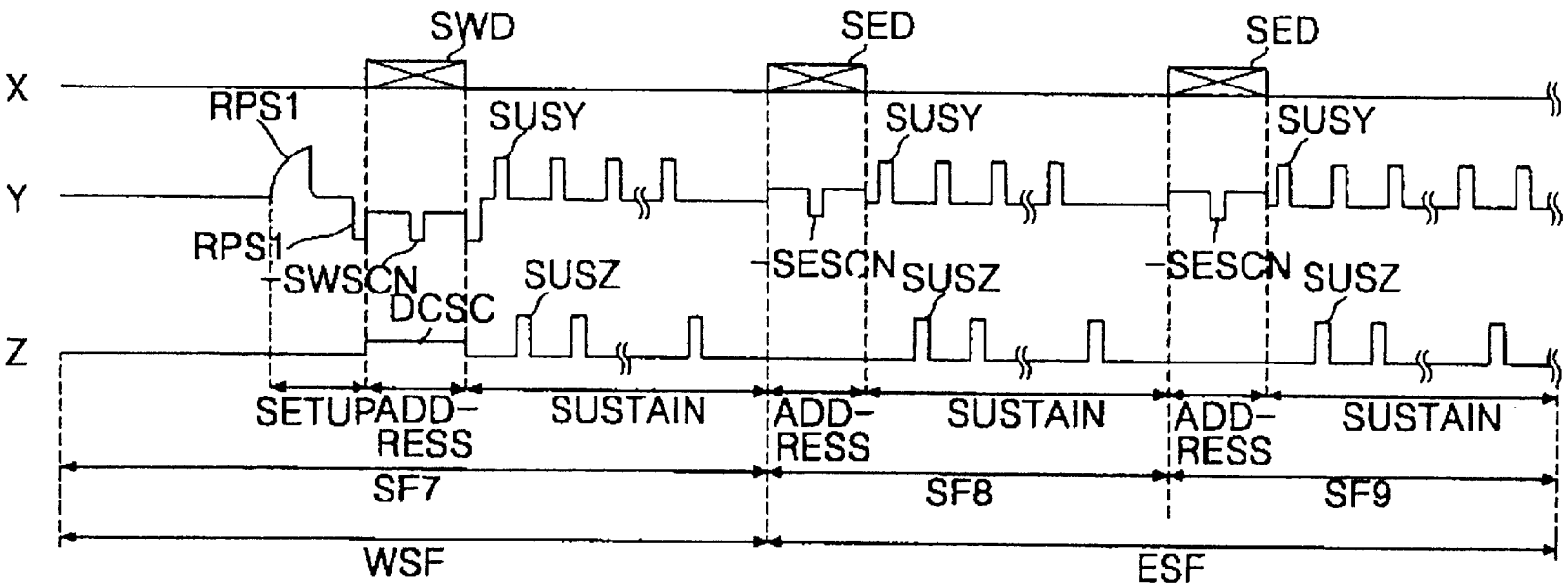

FIG. 10A and FIG. 10B show driving waveforms in the PDP driving method according to a third embodiment of the present invention.

Referring to FIG. 10A, the first sub-field SF1 causes a writing discharge at the discharge cells of the entire field to be preceded by a reset interval for initializing the entire field. To this end, a relatively large, positive reset pulse RSTP is applied to the common sustaining electrode lines Z in the reset interval or the setup interval. A first setup waveform RPS1 having a rising slope is applied to the scanning/sustaining electrode lines Y, and thereafter a negative pulse −RSTP and a second setup waveform RPS2 having a rising slope are applied thereto. Then, the discharge cells of the entire field conduct discharge, sustaining and erasure processes to uniform a wall charge amount at the interior thereof and erase electric charges unnecessary for the discharge.

In the address interval of the first writing sub-field SF1, a negative writing scanning pulse −SWSCN and a positive writing data pulse SWD are applied to the scanning/sustaining electrode lines Y and the address electrode lines X, respectively in such a manner to be synchronized with each other. Then, the selected discharge cells accumulate wall charges and space charges by the address discharge. In this interval, a positive scanning direct current voltage DCSC continues to be applied to the common sustaining electrode lines Z.

In the sustaining interval of the first sub-field SF1, sustaining pulses SUSY and SUSZ are alternately applied to the scanning/sustaining electrode lines Y and the common sustaining electrode lines Z. The sustaining pulses SUSY and SUSZ allow the discharge cells having been turned on by the address discharge to maintain a discharge. Discharge cells other than the discharge cells selected by the address discharge do not generate a sustaining discharge.

In the address intervals of the second and third sub-fields SF2 and SF3 which are the selective erasing sub-fields ESF, a negative erasing scanning pulse −SESCN and a positive erasing data pulse SED for turning off the discharge cell having been turned on in the previous sub-field are applied to the scanning/sustaining electrode lines Y and the address electrode lines X, respectively in such a manner to be synchronized with each other. The cells selected by the erasing scanning pulse −SESCN and the erasing data pulse SED cause a weak discharge to erase wall charges and space charges.

In the sustaining intervals of the second and third sub-fields SF2 and SF3, the sustaining pulses SUSY and SUSZ are alternately to the scanning/sustaining electrode lines Y and the common sustaining electrode lines Z. Owing to these sustaining pulses SUSY and SUSZ, a discharge of the discharge cells which is not turned off by the address discharge is sustained to keep a turn-on state.

Referring to FIG. 10B, the seventh sub-field SF7 is preceded by a setup interval for uniformly accumulating wall charges in the discharge cells of the entire field. In the setup interval, a separate reset pulse RSTP is not applied to the common sustaining electrode lines Z, but one ramp waveform RPS1 and one negative pulse −RSTP only are continuously applied to the scanning/sustaining electrode lines Y. A setup interval of the tenth sub-field SF10 also is supplied with the same waveform as that of the seventh sub-field SF7.

The eighth and ninth sub-fields SF1 and SF9 and the eleventh and twelfth sub-fields SF11 and SF12 which are the selective erasing sub-fields ESF are different in the sustaining interval and the number of sustaining pulses, but are driven with the same driving waveforms as the second and third sub-fields SF2 and SF3.

Alternatively, the reset interval of the first sub-field SF1 may be driven with a setup waveform applied in the setup intervals of other selective writing sub-fields WSF.

Gray levels and coding methods expressed by the PDP driving method according to the third embodiment to SF12 are indicated in the following tables:

TABLE 4-1

| Gray level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 |
| 2 | 1 | 1 | 0 | 0 | 0 | 0 | 0 | 0 | 0 | 0 | 0 | 0 |
| 3 | 1 | 1 | 1 | 0 | 0 | 0 | 0 | 0 | 0 | 0 | 0 | 0 |
| 4 | 0 | 0 | 0 | 1 | 0 | 0 | 0 | 0 | 0 | 0 | 0 | 0 |
| 5 | 1 | 0 | 0 | 1 | 0 | 0 | 0 | 0 | 0 | 0 | 0 | 0 |
| 6 | 1 | 1 | 0 | 1 | 0 | 0 | 0 | 0 | 0 | 0 | 0 | 0 |
| 7 | 1 | 1 | 1 | 1 | 0 | 0 | 0 | 0 | 0 | 0 | 0 | 0 |
| 8 | 0 | 0 | 0 | 1 | 1 | 0 | 0 | 0 | 0 | 0 | 0 | 0 |
| 9 | 1 | 0 | 0 | 1 | 1 | 0 | 0 | 0 | 0 | 0 | 0 | 0 |
| 10 | 1 | 1 | 0 | 1 | 1 | 0 | 0 | 0 | 0 | 0 | 0 | 0 |
| 11 | 1 | 1 | 1 | 1 | 1 | 0 | 0 | 0 | 0 | 0 | 0 | 0 |
| 12 | 0 | 0 | 0 | 1 | 1 | 1 | 0 | 0 | 0 | 0 | 0 | 0 |
| 13 | 1 | 0 | 0 | 1 | 1 | 1 | 0 | 0 | 0 | 0 | 0 | 0 |
| 14 | 1 | 1 | 0 | 1 | 1 | 1 | 0 | 0 | 0 | 0 | 0 | 0 |
| 15 | 1 | 1 | 1 | 1 | 1 | 1 | 0 | 0 | 0 | 0 | 0 | 0 |
| 16 | 0 | 0 | 0 | 0 | 0 | 0 | 1 | 0 | 0 | 0 | 0 | 0 |

TABLE 4-1-continued

| Gray level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 17 | 1 | 0 | 0 | 0 | 0 | 0 | 1 | 0 | 0 | 0 | 0 | 0 |
| 18 | 1 | 1 | 0 | 0 | 0 | 0 | 1 | 0 | 0 | 0 | 0 | 0 |
| 19 | 1 | 1 | 1 | 0 | 0 | 0 | 1 | 0 | 0 | 0 | 0 | 0 |
| 20 | 0 | 0 | 0 | 1 | 0 | 0 | 1 | 0 | 0 | 0 | 0 | 0 |
| 21 | 1 | 0 | 0 | 1 | 0 | 0 | 1 | 0 | 0 | 0 | 0 | 0 |
| 22 | 1 | 1 | 0 | 1 | 0 | 0 | 1 | 0 | 0 | 0 | 0 | 0 |
| 23 | 1 | 1 | 1 | 1 | 0 | 0 | 1 | 0 | 0 | 0 | 0 | 0 |
| 24 | 0 | 0 | 0 | 1 | 1 | 0 | 1 | 0 | 0 | 0 | 0 | 0 |
| 25 | 1 | 0 | 0 | 1 | 1 | 0 | 1 | 0 | 0 | 0 | 0 | 0 |
| 26 | 1 | 1 | 0 | 1 | 1 | 0 | 1 | 0 | 0 | 0 | 0 | 0 |
| 27 | 1 | 1 | 1 | 1 | 1 | 0 | 1 | 0 | 0 | 0 | 0 | 0 |
| 28 | 0 | 0 | 0 | 1 | 1 | 1 | 1 | 0 | 0 | 0 | 0 | 0 |
| 29 | 1 | 0 | 0 | 1 | 1 | 1 | 1 | 0 | 0 | 0 | 0 | 0 |
| 30 | 1 | 1 | 0 | 1 | 1 | 1 | 1 | 0 | 0 | 0 | 0 | 0 |
| 31 | 1 | 1 | 1 | 1 | 1 | 1 | 1 | 0 | 0 | 0 | 0 | 0 |
| 32 | 0 | 0 | 0 | 0 | 0 | 0 | 1 | 1 | 0 | 0 | 0 | 0 |
| 33 | 1 | 0 | 0 | 0 | 0 | 0 | 1 | 1 | 0 | 0 | 0 | 0 |
| 34 | 1 | 1 | 0 | 0 | 0 | 0 | 1 | 1 | 0 | 0 | 0 | 0 |
| 35 | 1 | 1 | 1 | 0 | 0 | 0 | 1 | 1 | 0 | 0 | 0 | 0 |
| 36 | 0 | 0 | 0 | 1 | 0 | 0 | 1 | 1 | 0 | 0 | 0 | 0 |
| 37 | 1 | 0 | 0 | 1 | 0 | 0 | 1 | 1 | 0 | 0 | 0 | 0 |

TABLE 4-2

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 0 | 1 | 0 | 0 | 1 | 1 | 0 | 0 | 0 | 0 | 38 |
| 1 | 1 | 1 | 1 | 0 | 0 | 1 | 1 | 0 | 0 | 0 | 0 | 39 |
| 0 | 0 | 0 | 1 | 1 | 0 | 1 | 1 | 0 | 0 | 0 | 0 | 40 |
| 1 | 0 | 0 | 1 | 1 | 0 | 1 | 1 | 0 | 0 | 0 | 0 | 41 |
| 1 | 1 | 0 | 1 | 1 | 0 | 1 | 1 | 0 | 0 | 0 | 0 | 42 |
| 1 | 1 | 1 | 1 | 1 | 0 | 1 | 1 | 0 | 0 | 0 | 0 | 43 |
| 0 | 0 | 0 | 1 | 1 | 1 | 1 | 1 | 0 | 0 | 0 | 0 | 44 |
| 1 | 0 | 0 | 1 | 1 | 1 | 1 | 1 | 0 | 0 | 0 | 0 | 45 |
| 1 | 1 | 0 | 1 | 1 | 1 | 1 | 1 | 0 | 0 | 0 | 0 | 46 |
| 1 | 1 | 1 | 1 | 1 | 1 | 1 | 1 | 0 | 0 | 0 | 0 | 47 |
| 0 | 0 | 0 | 0 | 0 | 0 | 1 | 1 | 1 | 0 | 0 | 0 | 48 |
| 1 | 0 | 0 | 0 | 0 | 0 | 1 | 1 | 1 | 0 | 0 | 0 | 49 |
| 1 | 1 | 0 | 0 | 0 | 0 | 1 | 1 | 1 | 0 | 0 | 0 | 50 |
| 1 | 1 | 1 | 0 | 0 | 0 | 1 | 1 | 1 | 0 | 0 | 0 | 51 |
| 0 | 0 | 0 | 1 | 0 | 0 | 1 | 1 | 1 | 0 | 0 | 0 | 52 |
| 1 | 0 | 0 | 1 | 0 | 0 | 1 | 1 | 1 | 0 | 0 | 0 | 53 |
| 1 | 1 | 0 | 1 | 0 | 0 | 1 | 1 | 1 | 0 | 0 | 0 | 54 |
| 1 | 1 | 1 | 1 | 0 | 0 | 1 | 1 | 1 | 0 | 0 | 0 | 55 |
| 0 | 0 | 0 | 1 | 1 | 0 | 1 | 1 | 1 | 0 | 0 | 0 | 56 |
| 1 | 0 | 0 | 1 | 1 | 0 | 1 | 1 | 1 | 0 | 0 | 0 | 57 |
| 1 | 1 | 0 | 1 | 1 | 0 | 1 | 1 | 1 | 0 | 0 | 0 | 58 |
| 1 | 1 | 1 | 1 | 1 | 0 | 1 | 1 | 1 | 0 | 0 | 0 | 59 |
| 0 | 0 | 0 | 1 | 1 | 1 | 1 | 1 | 1 | 0 | 0 | 0 | 60 |
| 1 | 0 | 0 | 1 | 1 | 1 | 1 | 1 | 1 | 0 | 0 | 0 | 61 |
| 1 | 1 | 0 | 1 | 1 | 1 | 1 | 1 | 1 | 0 | 0 | 0 | 62 |
| 1 | 1 | 1 | 1 | 1 | 1 | 1 | 1 | 1 | 0 | 0 | 0 | 63 |
| 0 | 0 | 0 | 0 | 0 | 0 | 0 | 0 | 0 | 1 | 0 | 0 | 64 |
| 1 | 0 | 0 | 0 | 0 | 0 | 0 | 0 | 0 | 1 | 0 | 0 | 65 |
| 1 | 1 | 0 | 0 | 0 | 0 | 0 | 0 | 0 | 1 | 0 | 0 | 66 |
| 1 | 1 | 1 | 0 | 0 | 0 | 0 | 0 | 0 | 1 | 0 | 0 | 67 |
| 0 | 0 | 0 | 1 | 0 | 0 | 0 | 0 | 0 | 1 | 0 | 0 | 68 |
| 1 | 0 | 0 | 1 | 0 | 0 | 0 | 0 | 0 | 1 | 0 | 0 | 69 |
| 1 | 1 | 0 | 1 | 0 | 0 | 0 | 0 | 0 | 1 | 0 | 0 | 70 |
| 1 | 1 | 1 | 1 | 0 | 0 | 0 | 0 | 0 | 1 | 0 | 0 | 71 |
| 0 | 0 | 0 | 1 | 1 | 0 | 0 | 0 | 0 | 1 | 0 | 0 | 72 |
| 1 | 0 | 0 | 1 | 1 | 0 | 0 | 0 | 0 | 1 | 0 | 0 | 73 |
| 1 | 1 | 0 | 1 | 1 | 0 | 0 | 0 | 0 | 1 | 0 | 0 | 74 |
| 1 | 1 | 1 | 1 | 1 | 0 | 0 | 0 | 0 | 1 | 0 | 0 | 75 |
| 0 | 0 | 0 | 1 | 1 | 1 | 0 | 0 | 0 | 1 | 0 | 0 | 76 |

TABLE 4-3

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 0 | 0 | 1 | 1 | 1 | 0 | 0 | 0 | 1 | 0 | 0 | 77 |
| 1 | 1 | 0 | 1 | 1 | 1 | 0 | 0 | 0 | 1 | 0 | 0 | 78 |
| 1 | 1 | 1 | 1 | 1 | 1 | 0 | 0 | 0 | 1 | 0 | 0 | 79 |
| 0 | 0 | 0 | 0 | 0 | 0 | 1 | 0 | 0 | 1 | 0 | 0 | 80 |
| 1 | 0 | 0 | 0 | 0 | 0 | 1 | 0 | 0 | 1 | 0 | 0 | 81 |
| 1 | 1 | 0 | 0 | 0 | 0 | 1 | 0 | 0 | 1 | 0 | 0 | 82 |
| 1 | 1 | 1 | 0 | 0 | 0 | 1 | 0 | 0 | 1 | 0 | 0 | 83 |
| 0 | 0 | 0 | 1 | 0 | 0 | 1 | 0 | 0 | 1 | 0 | 0 | 84 |
| 1 | 0 | 0 | 1 | 0 | 0 | 1 | 0 | 0 | 1 | 0 | 0 | 85 |
| 1 | 1 | 0 | 1 | 0 | 0 | 1 | 0 | 0 | 1 | 0 | 0 | 86 |
| 1 | 1 | 1 | 1 | 0 | 0 | 1 | 0 | 0 | 1 | 0 | 0 | 87 |
| 0 | 0 | 0 | 1 | 1 | 0 | 1 | 0 | 0 | 1 | 0 | 0 | 88 |
| 1 | 0 | 0 | 1 | 1 | 0 | 1 | 0 | 0 | 1 | 0 | 0 | 89 |
| 1 | 1 | 0 | 1 | 1 | 0 | 1 | 0 | 0 | 1 | 0 | 0 | 90 |
| 1 | 1 | 1 | 1 | 1 | 0 | 1 | 0 | 0 | 1 | 0 | 0 | 91 |
| 0 | 0 | 0 | 1 | 1 | 1 | 1 | 0 | 0 | 1 | 0 | 0 | 92 |
| 1 | 0 | 0 | 1 | 1 | 1 | 1 | 0 | 0 | 1 | 0 | 0 | 93 |
| 1 | 1 | 0 | 1 | 1 | 1 | 1 | 0 | 0 | 1 | 0 | 0 | 94 |
| 1 | 1 | 1 | 1 | 1 | 1 | 1 | 0 | 0 | 1 | 0 | 0 | 95 |
| 0 | 0 | 0 | 0 | 0 | 0 | 1 | 1 | 0 | 1 | 0 | 0 | 96 |
| 1 | 0 | 0 | 0 | 0 | 0 | 1 | 1 | 0 | 1 | 0 | 0 | 97 |
| 1 | 1 | 0 | 0 | 0 | 0 | 1 | 1 | 0 | 1 | 0 | 0 | 98 |
| 1 | 1 | 1 | 0 | 0 | 0 | 1 | 1 | 0 | 1 | 0 | 0 | 99 |
| 0 | 0 | 0 | 1 | 0 | 0 | 1 | 1 | 0 | 1 | 0 | 0 | 100 |
| 1 | 0 | 0 | 1 | 0 | 0 | 1 | 1 | 0 | 1 | 0 | 0 | 101 |
| 1 | 1 | 0 | 1 | 0 | 0 | 1 | 1 | 0 | 1 | 0 | 0 | 102 |
| 1 | 1 | 1 | 1 | 0 | 0 | 1 | 1 | 0 | 1 | 0 | 0 | 103 |
| 0 | 0 | 0 | 1 | 1 | 0 | 1 | 1 | 0 | 1 | 0 | 0 | 104 |
| 1 | 0 | 0 | 1 | 1 | 0 | 1 | 1 | 0 | 1 | 0 | 0 | 105 |
| 1 | 1 | 0 | 1 | 1 | 0 | 1 | 1 | 0 | 1 | 0 | 0 | 106 |
| 1 | 1 | 1 | 1 | 1 | 0 | 1 | 1 | 0 | 1 | 0 | 0 | 107 |
| 0 | 0 | 0 | 1 | 1 | 1 | 1 | 1 | 0 | 1 | 0 | 0 | 108 |
| 1 | 0 | 0 | 1 | 1 | 1 | 1 | 1 | 0 | 1 | 0 | 0 | 109 |
| 1 | 1 | 0 | 1 | 1 | 1 | 1 | 1 | 0 | 1 | 0 | 0 | 110 |
| 1 | 1 | 1 | 1 | 1 | 1 | 1 | 1 | 0 | 1 | 0 | 0 | 111 |
| 0 | 0 | 0 | 0 | 0 | 0 | 1 | 1 | 1 | 1 | 0 | 0 | 112 |
| 1 | 0 | 0 | 0 | 0 | 0 | 1 | 1 | 1 | 1 | 0 | 0 | 113 |
| 1 | 1 | 0 | 0 | 0 | 0 | 1 | 1 | 1 | 1 | 0 | 0 | 114 |
| 1 | 1 | 1 | 0 | 0 | 0 | 1 | 1 | 1 | 1 | 0 | 0 | 115 |
| 0 | 0 | 0 | 1 | 0 | 0 | 1 | 1 | 1 | 1 | 0 | 0 | 116 |
| 1 | 0 | 0 | 1 | 0 | 0 | 1 | 1 | 1 | 1 | 0 | 0 | 117 |

TABLE 4-4

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 0 | 1 | 0 | 0 | 1 | 1 | 1 | 1 | 0 | 0 | 118 |
| 1 | 1 | 1 | 1 | 0 | 0 | 1 | 1 | 1 | 1 | 0 | 0 | 119 |
| 0 | 0 | 0 | 1 | 1 | 0 | 1 | 1 | 1 | 1 | 0 | 0 | 120 |
| 1 | 0 | 0 | 1 | 1 | 0 | 1 | 1 | 1 | 1 | 0 | 0 | 121 |
| 1 | 1 | 0 | 1 | 1 | 0 | 1 | 1 | 1 | 1 | 0 | 0 | 122 |
| 1 | 1 | 1 | 1 | 1 | 0 | 1 | 1 | 1 | 1 | 0 | 0 | 123 |
| 0 | 0 | 0 | 1 | 1 | 1 | 1 | 1 | 1 | 1 | 0 | 0 | 124 |
| 1 | 0 | 0 | 1 | 1 | 1 | 1 | 1 | 1 | 1 | 0 | 0 | 125 |
| 1 | 1 | 0 | 1 | 1 | 1 | 1 | 1 | 1 | 1 | 0 | 0 | 126 |
| 1 | 1 | 1 | 1 | 1 | 1 | 1 | 1 | 1 | 1 | 0 | 0 | 127 |
| 0 | 0 | 0 | 0 | 0 | 0 | 0 | 0 | 0 | 1 | 1 | 0 | 128 |
| 1 | 0 | 0 | 0 | 0 | 0 | 0 | 0 | 0 | 1 | 1 | 0 | 129 |
| 1 | 1 | 0 | 0 | 0 | 0 | 0 | 0 | 0 | 1 | 1 | 0 | 130 |
| 1 | 1 | 1 | 0 | 0 | 0 | 0 | 0 | 0 | 1 | 1 | 0 | 131 |
| 0 | 0 | 0 | 1 | 0 | 0 | 0 | 0 | 0 | 1 | 1 | 0 | 132 |
| 1 | 0 | 0 | 1 | 0 | 0 | 0 | 0 | 0 | 1 | 1 | 0 | 133 |
| 1 | 1 | 0 | 1 | 0 | 0 | 0 | 0 | 0 | 1 | 1 | 0 | 134 |
| 1 | 1 | 1 | 1 | 0 | 0 | 0 | 0 | 0 | 1 | 1 | 0 | 135 |
| 0 | 0 | 0 | 1 | 1 | 0 | 0 | 0 | 0 | 1 | 1 | 0 | 136 |
| 1 | 0 | 0 | 1 | 1 | 0 | 0 | 0 | 0 | 1 | 1 | 0 | 137 |
| 1 | 1 | 0 | 1 | 1 | 0 | 0 | 0 | 0 | 1 | 1 | 0 | 138 |
| 1 | 1 | 1 | 1 | 1 | 0 | 0 | 0 | 0 | 1 | 1 | 0 | 139 |
| 0 | 0 | 0 | 1 | 1 | 1 | 0 | 0 | 0 | 1 | 1 | 0 | 140 |

TABLE 4-4-continued

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 0 | 0 | 1 | 1 | 1 | 0 | 0 | 0 | 1 | 1 | 0 | 141 |
| 1 | 1 | 0 | 1 | 1 | 1 | 0 | 0 | 0 | 1 | 1 | 0 | 142 |
| 1 | 1 | 1 | 1 | 1 | 1 | 0 | 0 | 0 | 1 | 1 | 0 | 143 |
| 0 | 0 | 0 | 0 | 0 | 0 | 1 | 0 | 0 | 1 | 1 | 0 | 144 |
| 1 | 0 | 0 | 0 | 0 | 0 | 1 | 0 | 0 | 1 | 1 | 0 | 145 |
| 1 | 1 | 0 | 0 | 0 | 0 | 1 | 0 | 0 | 1 | 1 | 0 | 146 |
| 1 | 1 | 1 | 0 | 0 | 0 | 1 | 0 | 0 | 1 | 1 | 0 | 147 |
| 0 | 0 | 0 | 1 | 0 | 0 | 1 | 0 | 0 | 1 | 1 | 0 | 148 |
| 1 | 0 | 0 | 1 | 0 | 0 | 1 | 0 | 0 | 1 | 1 | 0 | 149 |
| 1 | 1 | 0 | 1 | 0 | 0 | 1 | 0 | 0 | 1 | 1 | 0 | 150 |
| 1 | 1 | 1 | 1 | 0 | 0 | 1 | 0 | 0 | 1 | 1 | 0 | 151 |
| 0 | 0 | 0 | 1 | 1 | 0 | 1 | 0 | 0 | 1 | 1 | 0 | 152 |
| 1 | 0 | 0 | 1 | 1 | 0 | 1 | 0 | 0 | 1 | 1 | 0 | 153 |
| 1 | 1 | 0 | 1 | 1 | 0 | 1 | 0 | 0 | 1 | 1 | 0 | 154 |
| 1 | 1 | 1 | 1 | 1 | 0 | 1 | 0 | 0 | 1 | 1 | 0 | 155 |
| 0 | 0 | 0 | 1 | 1 | 1 | 1 | 0 | 0 | 1 | 1 | 0 | 156 |
| 1 | 0 | 0 | 1 | 1 | 1 | 1 | 0 | 0 | 1 | 1 | 0 | 157 |
| 1 | 1 | 0 | 1 | 1 | 1 | 1 | 0 | 0 | 1 | 1 | 0 | 158 |

TABLE 4-5

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 1 | 1 | 1 | 1 | 1 | 0 | 0 | 1 | 1 | 0 | 159 |
| 0 | 0 | 0 | 0 | 0 | 0 | 1 | 1 | 0 | 1 | 1 | 0 | 160 |
| 1 | 0 | 0 | 0 | 0 | 0 | 1 | 1 | 0 | 1 | 1 | 0 | 161 |
| 1 | 1 | 0 | 0 | 0 | 0 | 1 | 1 | 0 | 1 | 1 | 0 | 162 |
| 1 | 1 | 1 | 0 | 0 | 0 | 1 | 1 | 0 | 1 | 1 | 0 | 163 |
| 0 | 0 | 0 | 1 | 0 | 0 | 1 | 1 | 0 | 1 | 1 | 0 | 164 |
| 1 | 0 | 0 | 1 | 0 | 0 | 1 | 1 | 0 | 1 | 1 | 0 | 165 |
| 1 | 1 | 0 | 1 | 0 | 0 | 1 | 1 | 0 | 1 | 1 | 0 | 166 |
| 1 | 1 | 1 | 1 | 0 | 0 | 1 | 1 | 0 | 1 | 1 | 0 | 167 |
| 0 | 0 | 0 | 1 | 1 | 0 | 1 | 1 | 0 | 1 | 1 | 0 | 168 |
| 1 | 0 | 0 | 1 | 1 | 0 | 1 | 1 | 0 | 1 | 1 | 0 | 169 |
| 1 | 1 | 0 | 1 | 1 | 0 | 1 | 1 | 0 | 1 | 1 | 0 | 170 |
| 1 | 1 | 1 | 1 | 1 | 0 | 1 | 1 | 0 | 1 | 1 | 0 | 171 |
| 0 | 0 | 0 | 1 | 1 | 1 | 1 | 1 | 0 | 1 | 1 | 0 | 172 |
| 1 | 0 | 0 | 1 | 1 | 1 | 1 | 1 | 0 | 1 | 1 | 0 | 173 |
| 1 | 1 | 0 | 1 | 1 | 1 | 1 | 1 | 0 | 1 | 1 | 0 | 174 |
| 1 | 1 | 1 | 1 | 1 | 1 | 1 | 1 | 0 | 1 | 1 | 0 | 175 |
| 0 | 0 | 0 | 0 | 0 | 0 | 1 | 1 | 1 | 1 | 1 | 0 | 176 |
| 1 | 0 | 0 | 0 | 0 | 0 | 1 | 1 | 1 | 1 | 1 | 0 | 177 |
| 1 | 1 | 0 | 0 | 0 | 0 | 1 | 1 | 1 | 1 | 1 | 0 | 178 |
| 1 | 1 | 1 | 0 | 0 | 0 | 1 | 1 | 1 | 1 | 1 | 0 | 179 |
| 0 | 0 | 0 | 1 | 0 | 0 | 1 | 1 | 1 | 1 | 1 | 0 | 180 |
| 1 | 0 | 0 | 1 | 0 | 0 | 1 | 1 | 1 | 1 | 1 | 0 | 181 |
| 1 | 1 | 0 | 1 | 0 | 0 | 1 | 1 | 1 | 1 | 1 | 0 | 182 |
| 1 | 1 | 1 | 1 | 0 | 0 | 1 | 1 | 1 | 1 | 1 | 0 | 183 |
| 0 | 0 | 0 | 1 | 1 | 0 | 1 | 1 | 1 | 1 | 1 | 0 | 184 |
| 1 | 0 | 0 | 1 | 1 | 0 | 1 | 1 | 1 | 1 | 1 | 0 | 185 |
| 1 | 1 | 0 | 1 | 1 | 0 | 1 | 1 | 1 | 1 | 1 | 0 | 186 |
| 1 | 1 | 1 | 1 | 1 | 0 | 1 | 1 | 1 | 1 | 1 | 0 | 187 |
| 0 | 0 | 0 | 1 | 1 | 1 | 1 | 1 | 1 | 1 | 1 | 0 | 188 |
| 1 | 0 | 0 | 1 | 1 | 1 | 1 | 1 | 1 | 1 | 1 | 0 | 189 |
| 1 | 1 | 0 | 1 | 1 | 1 | 1 | 1 | 1 | 1 | 1 | 0 | 190 |
| 1 | 1 | 1 | 1 | 1 | 1 | 1 | 1 | 1 | 1 | 1 | 0 | 191 |
| 0 | 0 | 0 | 0 | 0 | 0 | 0 | 0 | 0 | 1 | 1 | 1 | 192 |
| 1 | 0 | 0 | 0 | 0 | 0 | 0 | 0 | 0 | 1 | 1 | 1 | 193 |
| 1 | 1 | 0 | 0 | 0 | 0 | 0 | 0 | 0 | 1 | 1 | 1 | 194 |
| 1 | 1 | 1 | 0 | 0 | 0 | 0 | 0 | 0 | 1 | 1 | 1 | 195 |
| 0 | 0 | 0 | 1 | 0 | 0 | 0 | 0 | 0 | 1 | 1 | 1 | 196 |
| 1 | 0 | 0 | 1 | 0 | 0 | 0 | 0 | 0 | 1 | 1 | 1 | 197 |
| 1 | 1 | 0 | 1 | 0 | 0 | 0 | 0 | 0 | 1 | 1 | 1 | 198 |

TABLE 4-6

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 1 | 1 | 0 | 0 | 0 | 0 | 0 | 1 | 1 | 1 | 199 |
| 0 | 0 | 0 | 1 | 1 | 0 | 0 | 0 | 0 | 1 | 1 | 1 | 200 |
| 1 | 0 | 0 | 1 | 1 | 0 | 0 | 0 | 0 | 1 | 1 | 1 | 201 |
| 1 | 1 | 0 | 1 | 1 | 0 | 0 | 0 | 0 | 1 | 1 | 1 | 202 |
| 1 | 1 | 1 | 1 | 1 | 0 | 0 | 0 | 0 | 1 | 1 | 1 | 203 |
| 0 | 0 | 0 | 1 | 1 | 1 | 0 | 0 | 0 | 1 | 1 | 1 | 204 |
| 1 | 0 | 0 | 1 | 1 | 1 | 0 | 0 | 0 | 1 | 1 | 1 | 205 |
| 1 | 1 | 0 | 1 | 1 | 1 | 0 | 0 | 0 | 1 | 1 | 1 | 206 |
| 1 | 1 | 1 | 1 | 1 | 1 | 0 | 0 | 0 | 1 | 1 | 1 | 207 |
| 0 | 0 | 0 | 0 | 0 | 0 | 1 | 0 | 0 | 1 | 1 | 1 | 208 |
| 1 | 0 | 0 | 0 | 0 | 0 | 1 | 0 | 0 | 1 | 1 | 1 | 209 |
| 1 | 1 | 0 | 0 | 0 | 0 | 1 | 0 | 0 | 1 | 1 | 1 | 210 |
| 1 | 1 | 1 | 0 | 0 | 0 | 1 | 0 | 0 | 1 | 1 | 1 | 211 |
| 0 | 0 | 0 | 1 | 0 | 0 | 1 | 0 | 0 | 1 | 1 | 1 | 212 |
| 1 | 0 | 0 | 1 | 0 | 0 | 1 | 0 | 0 | 1 | 1 | 1 | 213 |
| 1 | 1 | 0 | 1 | 0 | 0 | 1 | 0 | 0 | 1 | 1 | 1 | 214 |
| 1 | 1 | 1 | 1 | 0 | 0 | 1 | 0 | 0 | 1 | 1 | 1 | 215 |
| 0 | 0 | 0 | 1 | 1 | 0 | 1 | 0 | 0 | 1 | 1 | 1 | 216 |
| 1 | 0 | 0 | 1 | 1 | 0 | 1 | 0 | 0 | 1 | 1 | 1 | 217 |
| 1 | 1 | 0 | 1 | 1 | 0 | 1 | 0 | 0 | 1 | 1 | 1 | 218 |
| 1 | 1 | 1 | 1 | 1 | 0 | 1 | 0 | 0 | 1 | 1 | 1 | 219 |
| 0 | 0 | 0 | 1 | 1 | 1 | 1 | 0 | 0 | 1 | 1 | 1 | 220 |
| 1 | 0 | 0 | 1 | 1 | 1 | 1 | 0 | 0 | 1 | 1 | 1 | 221 |
| 1 | 1 | 0 | 1 | 1 | 1 | 1 | 0 | 0 | 1 | 1 | 1 | 222 |
| 1 | 1 | 1 | 1 | 1 | 1 | 1 | 0 | 0 | 1 | 1 | 1 | 223 |
| 0 | 0 | 0 | 0 | 0 | 0 | 1 | 1 | 0 | 1 | 1 | 1 | 224 |
| 1 | 0 | 0 | 0 | 0 | 0 | 1 | 1 | 0 | 1 | 1 | 1 | 225 |
| 1 | 1 | 0 | 0 | 0 | 0 | 1 | 1 | 0 | 1 | 1 | 1 | 226 |
| 1 | 1 | 1 | 0 | 0 | 0 | 1 | 1 | 0 | 1 | 1 | 1 | 227 |
| 0 | 0 | 0 | 1 | 0 | 0 | 1 | 1 | 0 | 1 | 1 | 1 | 228 |
| 1 | 0 | 0 | 1 | 0 | 0 | 1 | 1 | 0 | 1 | 1 | 1 | 229 |
| 1 | 1 | 0 | 1 | 0 | 0 | 1 | 1 | 0 | 1 | 1 | 1 | 230 |
| 1 | 1 | 1 | 1 | 0 | 0 | 1 | 1 | 0 | 1 | 1 | 1 | 231 |
| 0 | 0 | 0 | 1 | 1 | 0 | 1 | 1 | 0 | 1 | 1 | 1 | 232 |
| 1 | 0 | 0 | 1 | 1 | 0 | 1 | 1 | 0 | 1 | 1 | 1 | 233 |
| 1 | 1 | 0 | 1 | 1 | 0 | 1 | 1 | 0 | 1 | 1 | 1 | 234 |

TABLE 4-7

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 1 | 1 | 1 | 0 | 1 | 1 | 0 | 1 | 1 | 1 | 235 |
| 0 | 0 | 0 | 1 | 1 | 1 | 1 | 1 | 0 | 1 | 1 | 1 | 236 |
| 1 | 0 | 0 | 1 | 1 | 1 | 1 | 1 | 0 | 1 | 1 | 1 | 237 |
| 1 | 1 | 0 | 1 | 1 | 1 | 1 | 1 | 0 | 1 | 1 | 1 | 238 |
| 1 | 1 | 1 | 1 | 1 | 1 | 1 | 1 | 0 | 1 | 1 | 1 | 239 |
| 0 | 0 | 0 | 0 | 0 | 0 | 1 | 1 | 1 | 1 | 1 | 1 | 240 |
| 1 | 0 | 0 | 0 | 0 | 0 | 1 | 1 | 1 | 1 | 1 | 1 | 241 |
| 1 | 1 | 0 | 0 | 0 | 0 | 1 | 1 | 1 | 1 | 1 | 1 | 242 |
| 1 | 1 | 1 | 0 | 0 | 0 | 1 | 1 | 1 | 1 | 1 | 1 | 243 |
| 0 | 0 | 0 | 1 | 0 | 0 | 1 | 1 | 1 | 1 | 1 | 1 | 244 |
| 1 | 0 | 0 | 1 | 0 | 0 | 1 | 1 | 1 | 1 | 1 | 1 | 245 |
| 1 | 1 | 0 | 1 | 0 | 0 | 1 | 1 | 1 | 1 | 1 | 1 | 246 |
| 1 | 1 | 1 | 1 | 0 | 0 | 1 | 1 | 1 | 1 | 1 | 1 | 247 |
| 0 | 0 | 0 | 1 | 1 | 0 | 1 | 1 | 1 | 1 | 1 | 1 | 248 |
| 1 | 0 | 0 | 1 | 1 | 0 | 1 | 1 | 1 | 1 | 1 | 1 | 249 |
| 1 | 1 | 0 | 1 | 1 | 0 | 1 | 1 | 1 | 1 | 1 | 1 | 250 |
| 1 | 1 | 1 | 1 | 1 | 0 | 1 | 1 | 1 | 1 | 1 | 1 | 251 |
| 0 | 0 | 0 | 1 | 1 | 1 | 1 | 1 | 1 | 1 | 1 | 1 | 252 |
| 1 | 0 | 0 | 1 | 1 | 1 | 1 | 1 | 1 | 1 | 1 | 1 | 253 |
| 1 | 1 | 0 | 1 | 1 | 1 | 1 | 1 | 1 | 1 | 1 | 1 | 254 |
| 1 | 1 | 1 | 1 | 1 | 1 | 1 | 1 | 1 | 1 | 1 | 1 | 255 |

As can be seen from Table 4-1 to Table 4-7, the PDP driving method according to the third embodiment can continuously express total 256 gray level values of 0 to 255. The selective erasing sub-fields ESF express gray levels by the linear coding allowing a gray level expression only when the previous sub-field has been necessarily turned on. In other words, the second sub-field SF2, the third sub-field SF3, the fifth sub-field SF5, the sixth sub-field SF6, the eighth sub-field SF1, the ninth sub-field SF9, the eleventh sub-field SF11 and the twelfth sub-field SF12 successively turn off the cells turned on in the previous sub-field in accordance with their gray level values. For instance, the fourth sub-field SF4 must be in a turn-on state in order to turn on the fifth sub-field SF5, and the fifth sub-field SF5 must be in a turn-on state in order to turn on the sixth sub-field SF6. Accordingly, the sub-fields ESF driven by the selective writing system do not require a separate writing discharge for a selective erasure addressing.

In the PDP driving method according to the third embodiment, brightness weighting values of the first to twelfth sub-fields SF1 to SF12 are assigned to $2^0$, $2^0$, $2^0$, $2^2$, $2^2$, $2^2$, $2^4$, $2^4$, $2^4$, $2^6$, $2^6$, $2^6$ as seen from Table 4-1 to Table 4-7. In other words, the brightness weighting values of the selective erasing sub-fields ESF are set to be equal to those of the selective writing sub-fields WSF arranged at the front stage thereof.

When a PDP has a VGA class resolution, an address interval in the PDP driving method according to the third embodiment is 9.6 ms. Thus, the sustaining interval can be more assured. Herein, the address interval is a sum of 5.76 ms calculated by 3 $\mu$s(a pulse width of the selective writing scanning pulse)×480 lines×4(the number of selective writing sub-fields) per frame and 3.84 ms calculated by 1 $\mu$s(a pulse width of the selective erasing scanning pulse)×480 lines×8(the number of selective scanning sub-fields) per frame. Furthermore, the PDP driving method according to the third embodiment omits an erasing interval, so that it can assure the sustaining interval even though one frame consists of 12 sub-fields.

Moreover, the PDP driving method according to the third embodiment eliminates an entire writing interval from the selective erasing sub-fields ESF to improve a contrast ratio.

Figure 11:
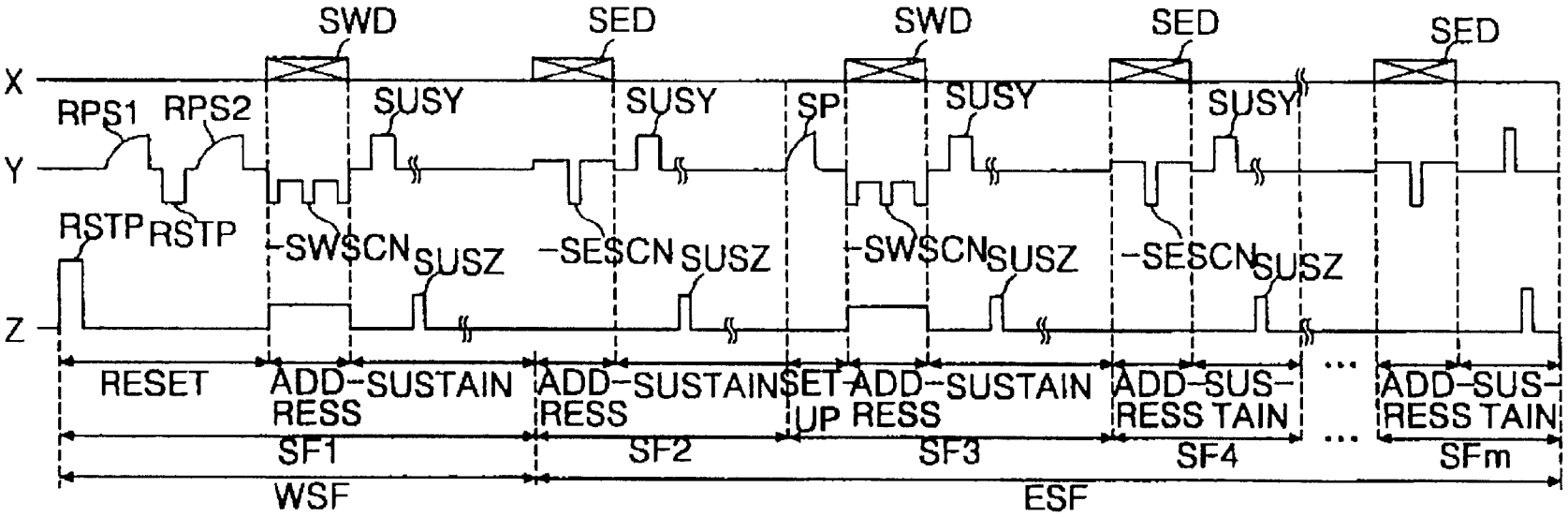
FIG. 11 is a waveform diagram of driving signals in a PDP driving method according to a fourth embodiment of the present invention.

FIG. 11 show driving waveforms in the PDP driving method according to a fourth embodiment of the present invention.

Referring to FIG. 11, in the PDP driving method according to the fourth embodiment, selective writing sub-fields WSF are followed by m selective erasing sub-fields ESF. The selective writing sub-field WSF includes the first sub-field SF1. The selective erasing sub-field ESF includes the second to mth sub-fields SF1 to SFm (wherein m is a positive integer). Thus, one frame includes (m+1) sub-fields.

The first sub-field SF1 is divided into a reset interval for turning off the entire field, a selective writing address interval for turning on the selected discharge cells and a sustaining interval for causing a sustaining discharge of the selected discharge cells. Each of the second to mth sub-fields SF2 to SFm does not have an entire writing period at which the entire field is written and is divided to a selective erasing address interval for turning off the selected discharge cells and a sustaining interval for causing a sustaining discharge of the remaining discharge cells other than the discharge cells selected by the address discharge.

Since driving waveforms of the selective writing sub-field WSF and the selective erasing sub-field ESF are identical to those in FIG. 10A and FIG. 10B, an explanation as to these driving waveforms will be omitted. A driving waveform in the reset interval of the first sub-filed SF1 can be replaced by the driving waveform in the setup interval in FIG. 10A and FIG. 10B.

Figure 12:
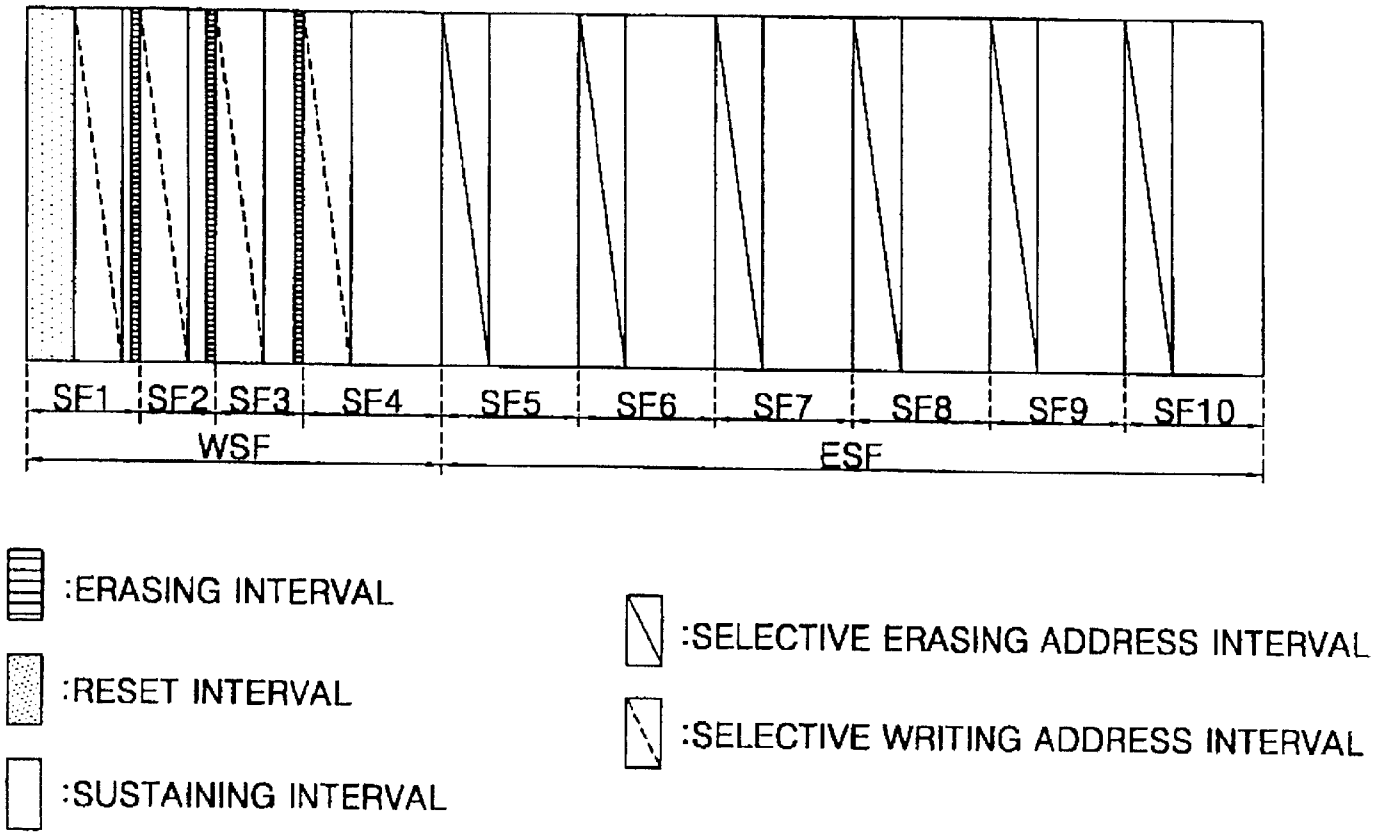
FIG. 12 is a waveform diagram of driving signals in a PDP driving method according to a fifth embodiment of the present invention.

FIG. 12 shows a configuration of one frame in a PDP driving method according to a fifth embodiment of the present invention.

Referring to FIG. 12, in the PDP driving method according to the fifth embodiment, one frame is divided into a selective writing sub-field WSF having 4 sub-fields SF1 to SF4 for expressing low gray level values and a selective erasing sub-field ESF having 6 sub-fields SF5 to SF10 for expressing high gray level values.

The first sub-field SF1 is divided into a reset interval for turning off the entire field, a selective erasing address interval for turning off the selected discharge cells and a sustaining interval for causing a sustaining discharge for the remaining discharge cells other than the discharge cells selected by the address discharge. In the sixth to eleventh sub-fields SF6 to SF11, the selective erasing address interval is set to be equal to the sustaining interval.

In frames including the selective writing sub-fields WSF and the selective erasing sub-fields ESF, the kth frame and the following (k+1)th frame (wherein k is a positive integer) are set to have a different brightness weighting value from each other in at least a portion of sub-fields Brightness weighting values assigned for each sub-field in the kth frame and the (k+1)th frame are is indicated in the following table:

TABLE 5

| Subfield | 1 | 2 | 3 | 4 | 5 | 6 | 7 | 8 | 9 | 10 |
|---|---|---|---|---|---|---|---|---|---|---|
| $K^{th}$ Frame | (2) | (8) | (16) | (32) | (32) | (32) | (32) | (32) | (32) | (32) |
| $(K + 1)^{th}$ Frame | (4) | (16) | (16) | (32) | (32) | (32) | (32) | (32) | (32) | (32) |

As can be seen from Table 5, in the PDP driving method according to the fifth embodiment, a relative brightness ratio of the selective writing sub-fields WSF for expressing low gray levels in the kth frame is set to be different from that in the (k+1)th frame. In the kth frame, brightness weighting values of the first to fourth sub-fields SF1 to SF4 are set to $2^2$, $2^4$, $2^5$ and $2^6$, respectively. On the other hand, in the (k+1)th frame, brightness weighting values of the first to fourth sub-fields SF1 to SF4 are set to $2^3$, $2^5$, $2^5$ and $2^6$, respectively. The sustaining interval and the discharge frequency of each selective writing sub-field WSF in the kth frame become different from those in the (k+1)th frame depending on the brightness weighting values set in this manner.

The selective erasing sub-fields ESF in the kth frame is set to be identical to those in the (k+1)th frame. In other words, brightness weighting values of the fifth to tenth sub-fields SF5 to SF10 in the kth frame are set to $2^6$ which is equal to those in the (k+1)th frame.

The first to fourth sub-fields SF1 to SF4 of the kth frame and the (k+1)th frame for expressing low gray level values are binary-coded. On the other hand, the fifth to tenth sub-fields SF5 to SF10 of the kth frame and the (k+1)th frame for expressing high gray level values are linearly coded. In other words, the first to fourth sub-fields SF1 to SF4 successively express a low gray level range by a combination of brightness weighting values expressed by a binary code, whereas the fifth to tenth sub-fields SF5 to SF10 successively turn off the discharge cells selected in the previous sub-field to express a high gray level range.

Such a gray level expression utilizes a fact that an integration value of brightness values expressed in each of the kth frame and the (k+1)th frame can be observed by an observer. This will be described in detail in conjunction with the following tables that represents a gray level expression of 0 to 32 and 64.

TABLE 6-1

| Gray level | Frame | Subfield 1 | 2 | 3 | 4 | 5 | 6 | 7 | 8 | 9 | 10 |
|---|---|---|---|---|---|---|---|---|---|---|---|
| 0 | k | x | x | x | x | x | x | x | x | x | x |
| | k + 1 | x | x | x | x | x | x | x | x | x | x |
| 1 | k | | x | x | x | x | x | x | x | x | x |
| | k + 1 | x | x | x | x | x | x | x | x | x | x |
| 2 | k | x | x | x | x | x | x | x | x | x | x |
| | k + 1 | | x | x | x | x | x | x | x | x | x |
| 3 | k | | x | x | x | x | x | x | x | x | x |
| | k + 1 | | x | x | x | x | x | x | x | x | x |
| 4 | k | x | | x | x | x | x | x | x | x | x |
| | k + 1 | x | x | x | x | x | x | x | x | x | x |
| 5 | k | | | x | x | x | x | x | x | x | x |
| | k + 1 | x | x | x | x | x | x | x | x | x | x |
| 6 | k | x | | x | x | x | x | x | x | x | x |
| | k + 1 | | x | x | x | x | x | x | x | x | x |
| 7 | k | | | x | x | x | x | x | x | x | x |
| | k + 1 | | x | x | x | x | x | x | x | x | x |
| 8 | k | x | x | x | x | x | x | x | x | x | x |
| | k + 1 | x | | x | x | x | x | x | x | x | x |
| 9 | k | | x | x | x | x | x | x | x | x | x |
| | k + 1 | x | | x | x | x | x | x | x | x | x |
| 10 | k | x | x | x | x | x | x | x | x | x | x |
| | k + 1 | | | x | x | x | x | x | x | x | x |
| 11 | k | | x | x | x | x | x | x | x | x | x |
| | k + 1 | | | x | x | x | x | x | x | x | x |
| 12 | k | x | | x | x | x | x | x | x | x | x |
| | k + 1 | x | | x | x | x | x | x | x | x | x |
| 13 | k | | | x | x | x | x | x | x | x | x |
| | k + 1 | x | | x | x | x | x | x | x | x | x |
| 14 | k | x | | x | x | x | x | x | x | x | x |
| | k + 1 | | | x | x | x | x | x | x | x | x |
| 15 | k | | | x | x | x | x | x | x | x | x |
| | k + 1 | | | x | x | x | x | x | x | x | x |
| 16 | k | x | x | | x | x | x | x | x | x | x |
| | k + 1 | x | x | | x | x | x | x | x | x | x |
| 17 | k | | x | | x | x | x | x | x | x | x |
| | k + 1 | x | x | | x | x | x | x | x | x | x |
| 18 | k | x | x | | x | x | x | x | x | x | x |
| | k + 1 | | x | | x | x | x | x | x | x | x |

TABLE 6-2

| Gray level | Frame | Subfield 1 | 2 | 3 | 4 | 5 | 6 | 7 | 8 | 9 | 10 |
|---|---|---|---|---|---|---|---|---|---|---|---|
| 19 | k | | x | | x | x | x | x | x | x | x |
| | k + 1 | | x | | x | x | x | x | x | x | x |
| 20 | k | x | | | x | x | x | x | x | x | x |
| | k + 1 | x | x | | x | x | x | x | x | x | x |
| 21 | k | | | | x | x | x | x | x | x | x |
| | k + 1 | x | x | | x | x | x | x | x | x | x |
| 22 | k | x | | | x | x | x | x | x | x | x |
| | k + 1 | | x | | x | x | x | x | x | x | x |
| 23 | k | | | | x | x | x | x | x | x | x |
| | k + 1 | | x | | x | x | x | x | x | x | x |
| 24 | k | x | x | | x | x | x | x | x | x | x |
| | k + 1 | x | | | x | x | x | x | x | x | x |
| 25 | k | | x | | x | x | x | x | x | x | x |
| | k + 1 | x | | | x | x | x | x | x | x | x |
| 26 | k | x | x | | x | x | x | x | x | x | x |
| | k + 1 | | | | x | x | x | x | x | x | x |
| 27 | k | | x | | x | x | x | x | x | x | x |
| | k + 1 | | | | x | x | x | x | x | x | x |

TABLE 6-2-continued

| Gray level | Frame | Subfield 1 | 2 | 3 | 4 | 5 | 6 | 7 | 8 | 9 | 10 |
|---|---|---|---|---|---|---|---|---|---|---|---|
| 28 | k | x | | | x | x | x | x | x | x | x |
| | k + 1 | x | | | x | x | x | x | x | x | x |
| 29 | k | | | | x | x | x | x | x | x | x |
| | k + 1 | x | | | x | x | x | x | x | x | x |
| 30 | k | x | | | x | x | x | x | x | x | x |
| | k + 1 | | | | x | x | x | x | x | x | x |
| 31 | k | | | | x | x | x | x | x | x | x |
| | k + 1 | | | | x | x | x | x | x | x | x |
| 32 | k | x | x | x | | x | x | x | x | x | x |
| | k + 1 | x | x | x | | x | x | x | x | x | x |
| 64 | k | x | x | x | | | x | x | x | x | x |
| | k + 1 | x | x | x | | | x | x | x | x | x |

As seen from Table 6-1, in order to express a gray level value of '1', only the first sub-field SF1 in the kth frame is turned on while the remaining kth frame and the entire (k+1)th frame are turned off. At this time, an observer can observe an image at a brightness having a weighting value of '2' in a sum interval of the kth frame and the (k+1)th frame. As a result, an observer observes an image at a brightness corresponding to a gray level value of '1' by the integration effect. Similarly, a gray level value '16' is expressed by turning on only the third sub-fields SF3 of the kth frame and the (k+1)th frame, each of which has a brightness weighting value of '16', while turning off the remaining sub-fields. A gray level value '32' is expressed by turning on only the fourth sub-fields SF4 of the kth frame and the (k+1)th frame, each of which has a brightness weighting value of '32'. A gray level value '33' as not indicated in Table 6-1 and Table 6-2 is expressed by turning on only the first sub-field SF1 of the kth frame which has a brightness weighting value of '2' and the fourth sub-fields SF4 of the kth frame and the (k+1)th frame, each of which has a brightness weighting value of '32', while turning off the remaining sub-fields.

As a result, the PDP driving method according to the fifth embodiment is capable of expressing 256 gray levels successively by utilizing the integration effect of two frames even when the address interval is more reduced. Also, it is capable of display a natural image even when the number of sub-fields is more reduced. More specifically, the prior art requires at least four sub-fields for an expression of total 16 gray levels from 0 until 15. Comparatively, the PDP driving method according to the fifth embodiment can express total 16 gray levels from 0 until 15 only by two sub-fields by giving a different weighting value to two frames and utilizing the integration effect of these two sub-fields.

A driving time and a contrast in the PDP driving method according to the fifth embodiment are as follows.

When a PDP has a VGA class resolution, a time required for an address interval is merely 8.64 ms. As the address interval is more reduced, the sustaining interval can be sufficiently assured into 6.43 ms. Herein, the address interval is a sum of 5.76 ms calculated by 3 $\mu$s(a pulse width of the selective writing scanning pulse)×480 lines×4(the number of selective writing sub-fields) per frame and 2.88 ms calculated by 1 $\mu$s(a pulse width of the selective erasing scanning pulse)×480 lines×6(the number of selective scanning sub-fields) per frame. The sustaining interval is a value (16.67 ms−8.64 ms−0.3 ms−1 ms−0.3 ms) subtracting an address interval of 8.64 ms, once reset interval of 0.3 ms, an extra time of the vertical synchronizing signal Vsync of 1 ms and an erasing period of 100 $\mu$s×3(the number of sub-fields)=0.3 ms from one frame interval of 16.67 ms.

If the entire field is turned on in the sustaining interval of 6.43 ms, a light of about 640 cd/m$^2$ corresponding to a brightness of the peak white is produced. On the other hand, if any field is turned on only in once reset interval within one frame, a light of about 0.7 cd/m$^2$ corresponding to the black is produced. Accordingly, a darkroom contrast ratio in the PDP driving method according to the fifth embodiment becomes a level of 910:1.

Meanwhile, driving waveforms of each frame in the PDP driving method according to the fifth embodiment can be used as the driving waveforms in FIG. 6 and FIG. 7 as far as the number of sub-fields is controlled.

Figure 13:
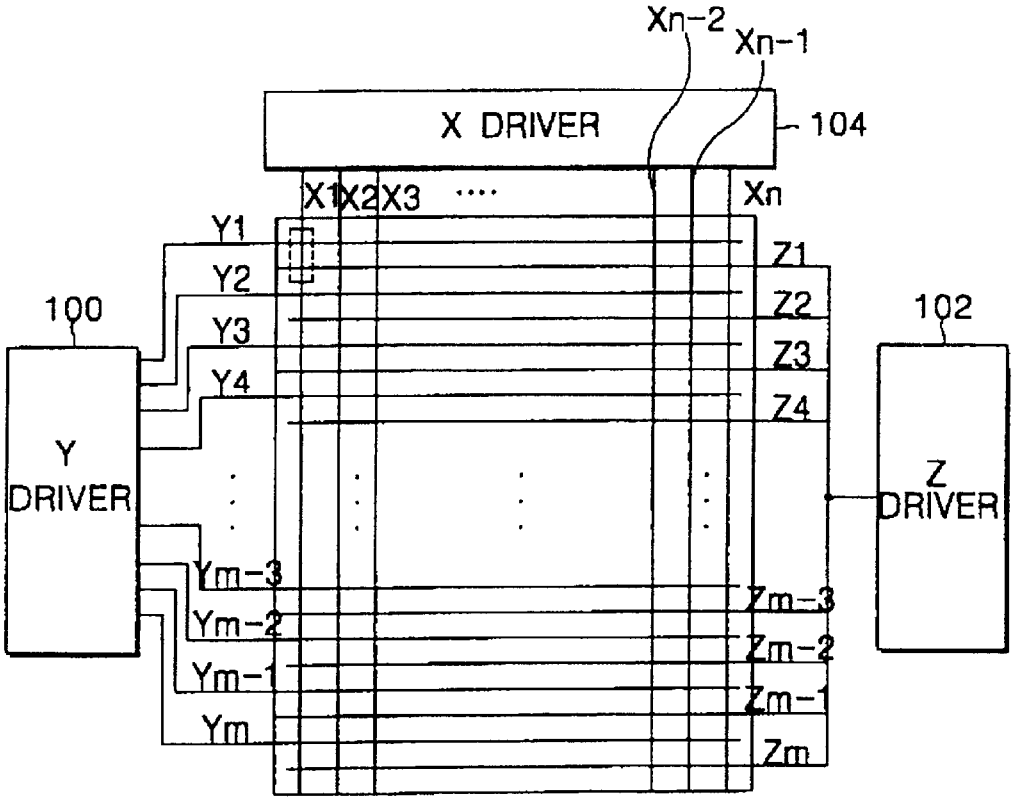
FIG. 13 is a schematic block diagram showing a configuration of a PDP driving apparatus according to an embodiment of the present invention.

FIG. 13 shows a PDP driving apparatus according to preferred embodiments of the present invention. The PDP driving apparatus will be described in conjunction with FIG. 6 that represents the driving waveforms according to the first embodiment of the present invention.

Referring to FIG. 13, the present PDP driving apparatus includes a Y driver 100 for driving m scanning/sustaining electrode lines Y1 to Ym, a Z driver 102 for driving m common sustaining electrode lines Z1 to Zm, and a X driver 104 for driving n address electrode lines X1 to Xn.

The Y driver 100 applies set-up/down waveforms RPSY and −RPSY in the selective writing sub-field WSF to initialize the entire field and, at the same time, sequentially applies different scanning pulses −SWSCN and −SESCN to the scanning/sustaining electrode lines Y1 to Ym in the selective writing sub-field WSF and the selective erasing sub-field SEF. Also, the Y driver 100 applies a sustaining pulse SUSY in the selective writing sub-field WSF and the selective erasing sub-field ESF to cause a sustaining discharge. The Z driver 102 is commonly connected to the common sustaining electrode lines Z1 to Zm to sequentially apply a set-down waveform −RPSZ to the Z electrode lines Z1 to Zm, a scanning DC voltage DCSC and a sustaining pulse SUSZ. The X driver 104 applies a writing data pulse SWD and an erasing data pulse SED to the address electrode lines X1 to Xn to be synchronized with the scanning pulses −SWSCN and −SESCN.

Figure 14:
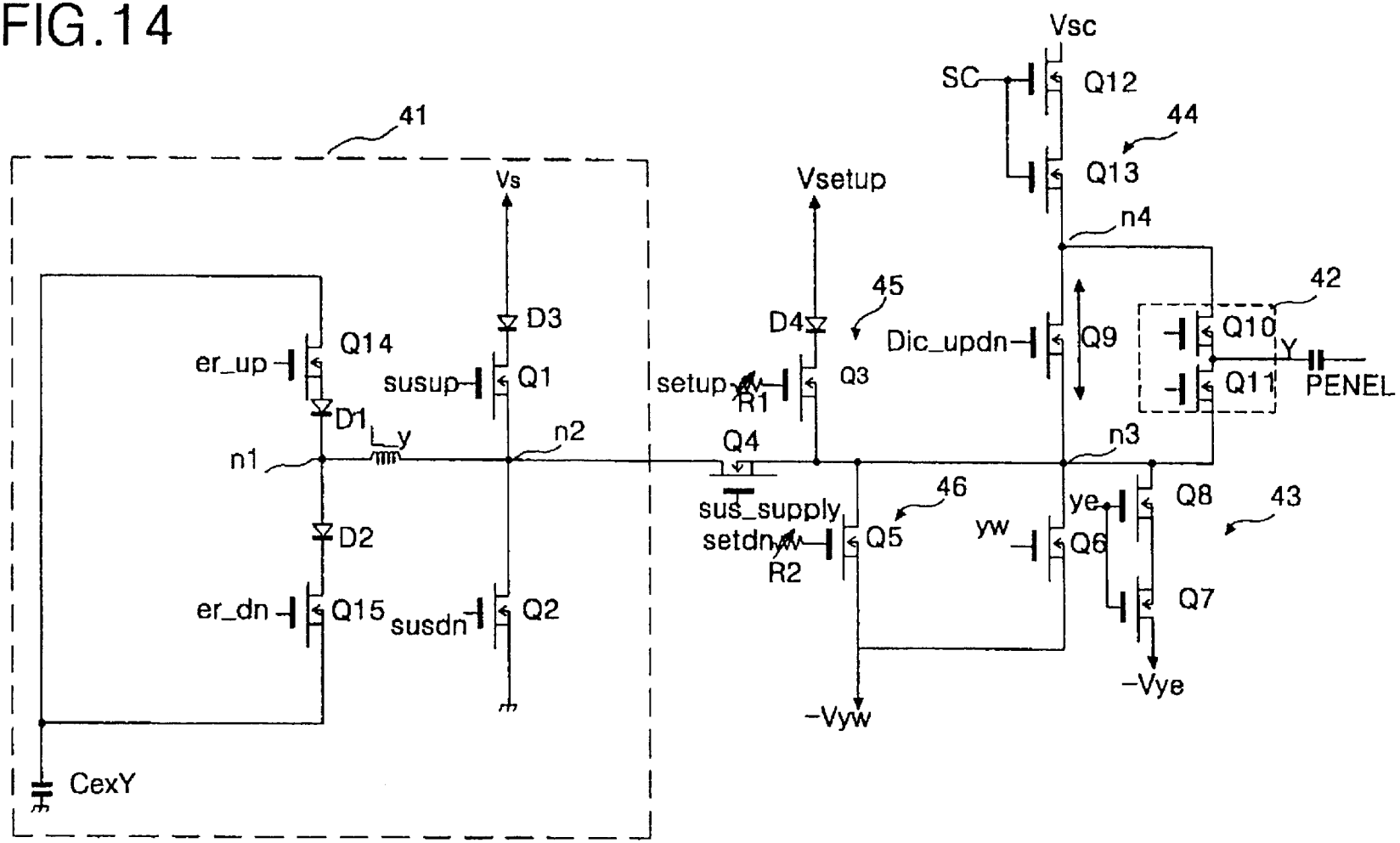
FIG. 14 is a detailed circuit diagram of the Y driver shown in FIG. 13.

FIG. 14 shows a detailed circuit diagram of the Y driver 100 for the purpose of explaining a configuration and an operation of the Y driver 100.

Referring to FIG. 14, the Y driver 100 includes a fourth switch Q4 connected between an energy recovery circuit 41 and a driver integrated circuit (IC) 42, a scanning reference voltage supplier 43 and a canning voltage supplier 44 connected between the fourth switch Q4 and the driver IC 42 to produce the scanning pulses −SWSCN and −SESCN, and a setup supplier 45 and a set-down supplier 46 connected among the fourth switch Q4, the scanning reference voltage supplier 43 and the scanning voltage supplier 44 to generate the set-up/down waveforms RPSY and −RPSY. The driver IC 42 is connected in a push-pull type and consists of tenth and eleventh switches Q10 and Q11 to which voltage signals are inputted from the energy recovery circuit 41, the scanning reference voltage supplier 43 and the scanning voltage supplier 44. An output line between the tenth and eleventh switches Q10 and Q11 is connected to any one of the scanning/sustaining electrode lines Y1 to Ym.

The energy recovery circuit includes an external capacitor CexY for charging a voltage recovered from the scanning/sustaining electrode lines Y1 to Ym, switches Q14 and Q15 connected, in parallel, to the external capacitor CexY, an inductor L_y connected between a first node n1 and a second node n2, a first switch Q1 connected between a sustaining voltage source Vs and a second node n2, and a second switch Q2 connected between the second node n2 and a ground terminal GND.

An operation of the energy recovery circuit will be described below. It is assumed that a voltage of Vs/2 has been charged in the external capacitor CexY. If a fourteenth switch Q14 is turned on, then a voltage charged in the external capacitor CexY is applied, via the capacitor Q14, a first diode D1 and the inductor $L_{13}$ y, to the driver IC 42 and is applied, via an internal diode (not shown) of the driver IC 42 to the scanning/sustaining electrode lines Y1 to Ym. At this time, the inductor L_y constitutes a serial LC resonance circuit along with a capacitance C within the cell to thereby apply a resonant waveform to the scanning/sustaining electrode lines Y1 to Ym. The first switch Q1 is turned on at a resonance point of the resonant waveform to apply the sustaining voltage Vs to the scanning/sustaining electrode lines Y1 to Ym. Then, each voltage level of the scanning/sustaining electrode lines Y1 to Ym maintains the sustaining voltage Vs. After a desired time, the first switch Q1 is turned off and a fifteenth switch Q15 is turned on. At this time, voltages of the scanning/sustaining electrode lines Y1 to Ym are recovered into the external capacitor CexY. In turn, when the fifteenth switch Q15 is turned off and the second switch Q2 is turned on, the voltages of the scanning/sustaining electrode lines Y1 to Ym remain at a ground potential.

When the voltages of the scanning/sustaining electrode lines Y1 to Ym are being charged or discharged by the energy recovery circuit 41, the switch Q4 is kept at an on-state so as to provide a current path between the energy recovery circuit 41 and the driver IC 42. As mentioned above, the energy recovery circuit 41 recovers voltages discharged from the scanning/sustaining electrode lines Y1 to Ym using the external capacitor CexY. Further, the energy recovery circuit 41 applies the recovered voltages to the scanning/sustaining electrode lines Y1 to Ym to reduce an excessive power consumption upon discharge in the setup interval and the sustaining interval.

The scanning reference voltage supplier 43 consists of a sixth switch Q6 connected between a third node n3 and a selective writing scanning voltage source −Vyw, and seventh and eighth switches Q7 and Q8 connected, in series, between the third node n3 and a selective erasing scanning voltage source −Vye. The sixth switch Q6 is switched in response to a control signal yw applied in the address interval of the selective writing sub-field WSF to apply a selective writing scanning voltage −Vyw to the driver IC 42.

The scanning voltage supplier 44 consists of switches Q12 and Q13 connected, in series, between a scanning voltage source Vsc and a fourth node n4. The switches Q12 and Q13 are switched in response to a control signal SC applied in the address interval of the selective writing sub-field WSF and the selective erasing sub-field ESF to apply a scanning voltage Vsc to the driver IC 42. The setup supplier 45 consists of a diode D4 and a switch Q3 connected to a setup voltage source Vsetup and the node n3. The diode D4 plays a role to shut off a backward current flowing from the node n3 into the setup voltage source Vsetup. The switch Q3 plays a role to apply a setup waveform RPSY. A slope of this setup waveform RPSY is determined by a RC time constant value of a RC time constant circuit connected to a control terminal, that is, a gate terminal of the switch Q3. Accordingly, the slope of the setup waveform RPSY is controlled by a resistance value adjustment of a variable resistor R1.

The set-down supplier 46 includes a fifth switch Q5 connected between the node n3 and the selective writing scanning voltage source −Vyw. The switch Q5 plays a role to apply a set-down waveform −RPSY. A slope of this set-down waveform −RPSY is determined by a RC time constant value of a RC time constant circuit connected to a control terminal, that is, a gate terminal of the switch Q5. Accordingly, the slope of the set-down waveform −RPSY is controlled by a resistance value adjustment of a variable resistor R2.

The Y driver 100 includes a ninth switch Q9 connected, via the node n3 and a node n4, to the scanning reference voltage supplier 43 and the scanning voltage supplier 44, respectively. The switch Q9 plays a role to switch the scanning voltage Vsc applied to the driver IC 42 in response to a control signal Dic_updn.

An operation of the Y driver 100 will be described in conjunction with FIG. 6.

In the reset interval of the selective writing sub-field WSF, the setup waveform RPSY and the set-down waveform −RPSY are continuously applied to the scanning/sustaining electrode lines Y. To this end, the switches Q3 and Q5 are sequentially turned on in response to the control signals setup and setdn, respectively. Then, a positive setup voltage Vsetup and a negative scanning reference voltage −Vyw are sequentially applied, via the switches Q3 and Q5 and the switch Q11 of the driver IC 42, to the scanning/sustaining electrode lines Y. The setup waveform RPSY rises until a setup voltage Vsetup and the set-down waveform −RPSY falls until a negative scanning reference voltage −Vyw. Herein, the setup voltage Vsetup is 240 to 260 V and which is set to be higher than the sustaining voltage (i.e., 170 to 190 V). The negative scanning reference voltage −Vyw is set to approximately −140 to −160 V. The setup waveform RPSY does not cause a large discharge within the cell and produces wall charged required upon scanning within the cell because it rises until the setup voltage Vsetup at a desired slope. In a falling edge of the setup waveform RPSY, the energy recovery circuit is operated and thus the setup waveform RPSY is controlled to have a slow slope. Since the setup waveform RPSY has a slow falling slope, the cells do not undergo a self-erasure and a voltage margin of the set-down waveform −RPSZ applied to the common sustaining electrode lines Z1 to Zm is widened.

In the address interval of the selective writing sub-field WSF, the switches Q12 and Q13 are turned on while the switch Q9 is turned off to apply a scanning voltage Vsc to the driver IC 42. Further, the switch Q6 is turned on to apply a selective writing scanning voltage −Vyw to the driver IC 42. Then, a writing scanning pulse −SWSCN is sequentially applied to the scanning/sustaining electrode lines Y1 to Ym. A voltage level of this writing scanning pulse −SWSCN is set to 60 to 80 V. A writing video data pulse SWD having a logical value of '1' is applied in synchronization with the writing scanning pulse −SWSCN. As a result, a writing discharge is generated at the selected discharge cells by a voltage difference between the writing scanning pulse −SWSCN having a large pulse width and the writing video data pulse SWD. Wall charges and space charges are produced within the discharge cells in which a writing discharge has been generated. By these wall charges and space charges, the selected discharge cells are charged with wall charges capable of causing a discharge by a sustaining pulse applied in the following sustaining interval. The switch Q9 maintains an off-state when the scanning pulse −SWSCN is being applied while maintaining an on-state in the remaining period.

In the sustaining interval of the selective writing sub-field WSF, a normal sustaining pulse SUSY2 having a small pulse width and a last sustaining pulse SUSY3 having a large pulse width are successively applied after a first sustaining pulse SUSY1 having a large pulse width was applied to the scanning/sustaining electrode lines Y. At this time, the energy recovery circuit 41 applies a resonant waveform to the driver IC 42 by utilizing a voltage charged in the external capacitor CexY and the LC resonance and thereafter turns on the switch Q1 to apply a sustaining voltage Vs to the driver IC 42. The discharge cells that have generate a writing discharge in the address interval generate sustaining discharges by the number of sustaining pulses SUSY1, SUSY2 and SUSY3. The discharge cells that have not generate a writing discharge in the address interval does not generate a discharge because they have almost not any wall charges even when a sustaining voltage Vs caused by the sustaining pulses SUSY1, SUSY2 and SUSY3. The first sustaining pulse SUSY1 has a pulse width of about 20 μs so that a stable sustaining discharge initiation can be made. The second sustaining pulse SUSY2 has a pulse width of about 2.5 to 5 μs. The third sustaining pulse SUSY3 is set to have a pulse width of more than 5 μs so that a sustaining discharge can not be self-erased.

In the last time of the selective writing sub-field WSF, an erasing pulse ERSPY and a reset pulse RSTP having a large pulse width is applied depending on whether the following sub-field is the selective writing sub-field WSF or the selective erasing sub-field ESF. If the following sub-field is the selective writing sub-field WSF, then an erasing pulse ERSPY making a group along with an erasing pulse ERSPZ applied to the common sustaining electrode lines Z and a ramp waveform RAMP are applied to the scanning/sustaining electrode lines Y at the end time of the current selective writing sub-field WSF. One group of the erasing pulse ERSPY and ERSPZ and the ramp waveform RAMP cause a weak discharge continuously to erase a sustaining discharge of the selected discharge cells.

Further, the erasing pulses ERSPY and ERSPZ and the ramp waveform RAMP causes a discharge as weak as possible continuously to uniformly accumulate wall charges within the cells of the entire field at a primary time of the following selective writing sub-field WSF. The erasing pulses ERSPY and ERSPZ are rectangular waves having a small pulse width within about 1 μs while the ramp waveform RAMP is set to have a pulse width of about 20 μs.

On the other hand, if the following sub-field is the selective erasing sub-field ESF, then the third sustaining pulse SUSY3, which is a rectangular wave having a large pulse width, is applied at the end time of the current selective writing sub-field WSF. This third sustaining pulse SUSY3 produces sufficient wall charges at the currently turned-on cells to permit a stable addressing operation in the following erasing sub-field ESF.

Meanwhile, if the following sub-field is the selective erasing sub-field ESF, then a pulse applied at the end time of the current selective writing sub-field WSF can have a large pulse width or may be set to have a larger voltage level than the normal sustaining pulse. Otherwise, if the following sub-field is the selective erasing sub-field ESF, then a pulse applied at the end time of the current selective writing sub-field WSF may have a larger pulse width and a larger voltage level than a sustaining pulse applied in the sustaining interval.

In the selective erasing sub-field ESF, a reset interval is omitted. This is because the last sustaining pulse SUSY3 or SUSY5 generated at the end time of the current selective writing sub-field WSF or the current selective erasing sub-field ESF plays a role to turn on the cells in the next selective erasing sub-field ESF. Accordingly, an address interval is set at a primary time of the selective erasing sub-field ESF.

In the address interval of the selective erasing sub-field ESF, the switches Q12 and Q13 are turned on to apply a scanning voltage Vs to the driver IC 42. The switches Q7 and Q8 are turned on to apply a selective erasing scanning voltage −Vye to the driver IC 42. Then, an erasing scanning pulse −SESCN is sequentially to the scanning/sustaining electrode lines Y1 to Ym. Herein, a voltage level of the erasing scanning pulse −SESCN is set to about 60 to 80 V. An erasing video data pulse SED having a logical value of '0' is applied in synchronization with the erasing scanning pulse −SESCN. As a result, the selected discharge cells generates a weak erasure discharge by a voltage difference between the erasing scanning pulse −SESCN having a small pulse width and the erasing video data pulse SED. By this discharge, wall charges and space charges within the discharge cell is re-combined to be erased. Thus, the discharge cells having generate an erasure discharge by the erasing scanning pulse −SESCN and the erasing video data pulse SED does not generate a discharge even when a sustaining pulse is applied because they are not charged with a voltage required for a discharge. The switches Q9 maintains an off-state when the scanning pulse −SESCN is being applied while maintaining an on-state in the remaining time interval.

In the sustaining interval of the selective erasing sub-field ESF, a normal sustaining pulse SUSY4 having a pulse width of about 2.5 to 5 μs is applied. At this time, the energy recovery circuit 41 turns on the switch Q1 to apply a sustaining voltage Vs to the driver IC 42 after applying a resonant waveform to the driver IC 42 by utilizing a voltage charged in the external capacitor CexY and the LC resonance. Since the discharge cells having generated an erasure discharge in the address discharge have almost not wall charges, they do not generate even when the sustaining voltage Vs is applied by the sustaining voltage pulse SUSY4. On the other hand, the discharge cells having not generated an erasure discharge in the address interval are charged into a voltage capable of generating a discharge because a wall voltage charged in the reset interval or the setup interval is added to the sustaining voltage Vs. Thus, the discharge cells having not generated an erasure discharge in the address interval generate a discharge by the number of sustaining pulse SUSY4.

At the end time of the selective erasing sub-field ESF, a sustaining pulse SUSY 5 having a large pulse width or an erasing pulse ERSPY having a small pulse width is applied depending on whether the following sub-field is the selective erasing sub-field ESF or the selective writing sub-field WSF. If the following sub-field is the selective erasing sub-field ESF, the sustaining pulse SUSY5 having a large pulse width is applied so as to turn on the discharge cells at the end time of the current selective erasing sub-field ESF. If the following sub-field is the selective writing sub-field WSF, then an erasing pulse ERSPY making a group along with an erasing pulse ERSPZ applied to the common sustaining electrode lines Z1 to Zm and a ramp waveform RAMP is applied to the scanning/sustaining electrode lines Y1 to Ym at the end time of the current selective erasing sub-field ESF. The erasing sub-fields ERSPY and ERSPZ and the ramp waveform RAMP successively generate a weak discharge such that wall charges within the cells of the entire field can be generated at the primary time of the next selective writing sub-field WSF. By the erasing pulses ERSPY and ERSPZ and the ramp waveform RAMP, uniform wall charges and space charges are accumulated in the discharge cells of the entire field.

Figure 15:
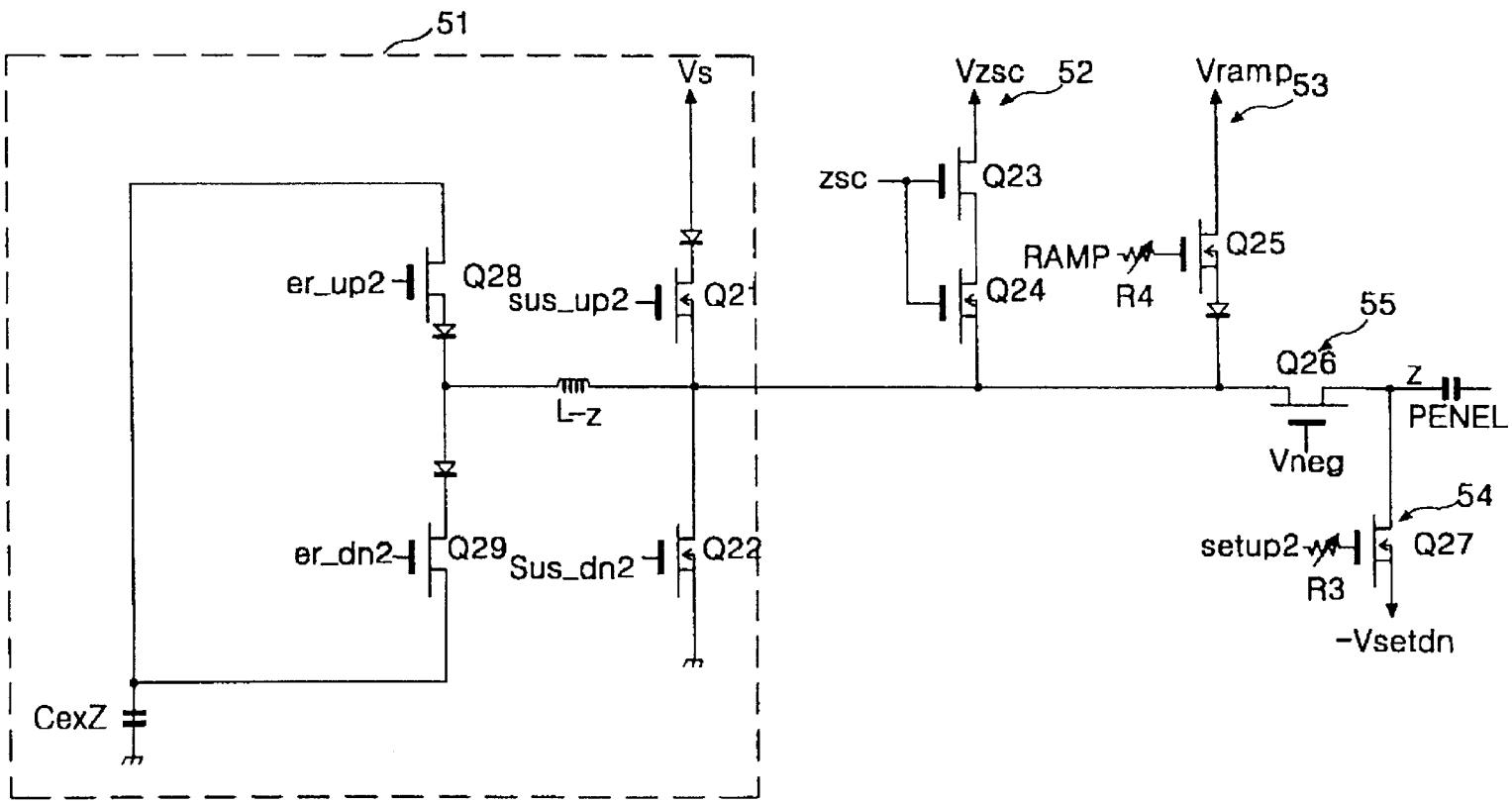
FIG. 15 is a detailed circuit diagram of the Z driver shown in FIG. 13.

FIG. 15 is a detailed circuit diagram of the Z driver 102.

Referring to FIG. 15, the Z driver 102 includes a scanning voltage supplier 52, a ramp voltage supplier 53, a polarity switch 55 and a set-down voltage supplier 54 that are connected between the energy recovery circuit 51 and the common sustaining electrode line Z. In similarity to the Y driver 100, The energy recovery circuit 51 charges voltages of the common sustaining electrode lines Z1 to Zm by utilizing the charged voltage of the external capacitor CexZ and the LC resonance, and recovers an energy from the common sustaining electrode lines Z1 to Zm to charge the external capacitor CexZ. The energy recovery circuit is driven upon application of a sustaining voltage Vs, a scanning voltage Vzsc and a ramp voltage Vramp.

An operation of the Z driver 102 will be described in conjunction with FIG. 6 below.

In the reset interval of the selective writing sub-field WSF, a negative set-down waveform −RPSZ is applied to the common sustaining electrode lines Z1 to Zm. To this end, a switch Q27 is turned on in response to a control signal setup2 to apply a negative set-down voltage −Vsetdn to the common sustaining electrode lines Z1 to Zm. The set-down voltage is set to about −160 to −180 V. A falling edge slope of the set-down waveform −RPSZ can be controlled by a resistance value adjustment of a variable resistor R3 connected to a control terminal, that is, a gate terminal of the switch Q27. The switch Q26 maintains an off-state when the set-down waveform −RPSZ is being applied to the common sustaining electrode lines Z1 to Zm. At the rising edge of the set-down waveform −RPSZ, the switch Q27 is turned off while switches Q22 and Q26 are turned on, to thereby raise a voltage level of the common sustaining electrode line Z into a ground potential GND.

In the address interval of the selective writing sub-field WSF, a positive DC voltage Vzsc is applied to the common sustaining electrode lines Z. Herein, the DC voltage Vzcs is set to about 90 to 110 V. To this end, at an initiation time of the address interval, the switch Q22 is turned off while the switches Q23 and Q24 are turned on in response to a control signal zsc. The turned-on switches Q23 and Q24 apply a scanning voltage Vzsc to the common sustaining electrode lines Z. This scanning voltage Vzsc charges the common sustaining electrode lines Z into a positive voltage, thereby preventing an erroneous discharge from being generated between the common sustaining electrode lines Z and the address electrode lines X in the address interval. A set-down end time of the common sustaining electrode lines Z1 to Zm, a time rising into the ground potential GND, an application time of the DC voltage Vzsc to the common sustaining electrode lines Z1 to Zm and an end time of the reset interval of the scanning/sustaining electrode lines Y1 to Ym are changed into a multiple step. Accordingly, internal voltages of the discharge cells are not changed suddenly, but a stable setup operation of the reset interval can be made.

In the sustaining interval of the selective writing sub-field WSF, a first sustaining pulse SUSZ1 having a large pulse width is applied and thereafter a second sustaining pulse SUSZ2 having a normal pulse width is applied. The sustaining pulse SUSZ1 has a pulse width of about 20 μs such that a stable sustaining discharge initiation can be made while the second sustaining pulse SUSZ2 has a pulse width of 2.5 to 5 μs.

If the following sub-field is a selective writing sub-field WSF, an the erasing pulse ERSPZ and a ramp waveform RAMP making a group are applied to the common sustaining electrode lines Z1 to Zm at the end time of the current selective writing sub-field WSF or the current selective erasing sub-field ESF. To this end, the switch Q25 is turned on to apply a ramp voltage Vramp to the common sustaining electrode lines Z1 to Zm. A rising edge slope of the ramp waveform RAMP is determined by a resistance value of a variable resistor R4 connected to a control terminal, that is, a gate terminal of the switch Q25.

In the address interval of the selective erasing sub-field ESF, voltages of the common sustaining electrode lines Z1 to Zm remain at a ground potential.

In the sustaining interval of the selective erasing sub-field ESF, the sustaining pulses SUSZ3 and SUSZ4 are applied to the common sustaining electrode lines Z1 to Zm in similarity to the sustaining interval of the selective writing sub-field WSF.

The present PDP driving apparatus is limited to the first embodiment, but is applicable to another embodiments. More specifically, the present PDP driving apparatus can be applied to another embodiment in which the selective writing sub-fields WSF are compatible with the selective erasing sub-fields ESF by controlling an arrangement of sub-fields and the brightness weighting value. Alternatively, the present PDP driving apparatus may be applicable to still another embodiment in which the selective writing sub-fields WSF are compatible with the selective erasing sub-field ESF and a relative brightness ratio between frames are set differently.

As described above, according to the present invention, one frame is divided into the sub-fields driven by the selective writing system and the sub-fields driven by the selective erasing system without an entire writing period. Accordingly, the address interval is considerably shortened in comparison to the selective writing system, so that the sustaining interval can be sufficiently assured. The present PDP driving method and apparatus permits a driving even when the number of sub-fields is enlarged so as to reduce a pseudo contour noise of a moving picture as well as a high-speed driving, so that it is suitable for driving a high-resolution panel.

Furthermore, according to the present invention, a time interval generating a discharge in the non-display interval is merely once reset interval and the display interval can be sufficiently assured, so that a contrast ratio can be more enlarged in comparison to the selective erasing system as well as the selective writing system. Also, a circuit for coupling the scanning voltages applied to the selective writing sub-fields and the selective erasing sub-fields and a circuit for obtaining a stable setup operation and a stable sustaining operation are provided. As a result, the present PDP driving method and apparatus is suitable for a compatible use of the selective writing sub-fields and the selective erasing sub-fields within one frame.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel in which a plurality of sub-fields each including an address interval for selecting a cell and a sustaining interval for causing a sustaining discharge of the selected cell are used to display an image, said method comprising the steps of:

turning on discharge cells selected in said address interval using at least one selective writing sub-field; and turning off the discharge cells selected in said address interval using at least one selective erasing sub-field, wherein the selective writing sub-field and the selective erasing sub-field are arranged within one frame.

2. The method as claimed in claim 1, wherein all of said at least one selective writing sub-field are arranged at a primary stage of said frame such that they precede said at least one selective erasing sub-field.

3. The method as claimed in claim 1, wherein said at least selective erasing sub-field is arranged between the selective writing sub-fields.

4. The method as claimed in claim 1, wherein said selective writing sub-field comprises:

a first selective writing sub-field including a reset interval for initializing the entire field, a selective writing address interval for selectively turning on the discharge cells, a sustaining interval for causing a sustaining discharge of the discharged cells turned on in the address interval, and an erasure interval for turning off the entire field;

a last selective writing sub-field being adjacent to the selective erasing sub-field and including the selective writing address interval and the sustaining interval; and at least one middle selective writing sub-field being arranged between the first selective writing sub-field and the last selective writing sub-field and including said selective writing address interval, said sustaining interval and said erasure interval.

5. The method as claimed in claim 4, wherein said last selective writing sub-field and said selective erasing sub-field express gray levels by a combination of linear codes in which the next sub-field is not turned on until the previous sub-field is turned on.

6. The method as claimed in claim 4, wherein said selective writing address interval and said erasure interval are equal to each other every selective writing sub-field, and said sustaining interval is set differently depending on a brightness weighting value assigned to the corresponding selective writing sub-field.

7. The method as claimed in claim 1, wherein said middle selective writing sub-fields and said last selective writing sub-fields further include the reset period prior to the selective writing address period, respectively.

8. The method as claimed in claim 1, wherein said selective erasing sub-field comprises:

a selective erasing address interval for selectively turning off the discharge cells turned on in the previous sub-field; and a sustaining interval for causing a sustaining discharge of the remaining discharge cells excluding the discharge cells turned off in the selective erasing address interval.

9. The method as claimed in claim 8, wherein said sustaining interval is set equally for each selective erasing sub-field.

10. The method as claimed in claim 8, wherein said sustaining interval is set differently between the selective erasing sub-fields depending on a brightness weighting value assigned to the corresponding selective erasing sub-field.

11. The method as claimed in claim 1, wherein gray level values are expressed by a combination of the selective writing sub-field and the selective erasing sub-field, and a portion of said gray level values is expressed by a Dithering technique and/or an error diffusion technique.

12. A method of driving a plasma display panel, comprising the steps of:

expressing a gray level range using at least one selective writing sub-field by turning on selected discharge cells and maintaining a discharge of the turned-on cells; and expressing a high gray level range using at least one selective erasing sub-field by successively turning off the cells turned on in the previous sub-field.

13. The method as claimed in claim 12, wherein a portion of the selective writing sub-fields expresses gray level values within said low gray level range by a binary code combination.

14. The method as claimed in claim 12, wherein the selective erasing sub-fields express gray level values within said high gray level range by a linear code combination.

15. A method of driving a plasma display panel in which a plurality of sub-fields each including an address interval for selecting a cell and a sustaining interval for causing a sustaining discharge of the selected cell are used to display an image, said method comprising:

a kth frame including at least one selective writing sub-field for turning on the discharge cells selected in the address interval and at least one erasing sub-field for turning off the discharge cells selected in the address interval; and a (k+1)th frame including at least one selective writing sub-field for turning on the discharge cells selected in the address interval and at least one erasing sub-field for turning off the discharge cells selected in the address interval and having brightness weighting values of the sub-fields different from said kth frame, wherein k is a positive integer.

16. A driving apparatus for a plasma display panel wherein the panel is provided with electrodes for causing a discharge and a plurality of sub-fields each including an address interval for selecting a cell and a sustaining interval for causing a sustaining discharge of the selected cell are used to display an image, said apparatus comprising:

a first electrode driver for applying a first scanning pulse for causing a writing discharge and a second scanning pulse for causing an erasure discharge to a first electrode of said panel in the address interval in accordance with a sub-field to drive the first electrode; and a second electrode driver for applying a first data for selecting the turned-on cells and a second data for selecting the turned-off cells to a second electrode of said panel in such a manner to be synchronized with the scanning pulses, thereby driving the second electrode.

17. The driving apparatus as claimed in claim 16, further comprising:

a third electrode driver for applying a desired direct current voltage to a third electrode of said panel in the address interval and applying a sustaining pulse for causing a sustaining discharge of the discharge cells selected in the address interval to the third electrode to thereby drive the third electrode.

18. The driving apparatus as claimed in claim 17, wherein the first electrode driver and the third electrode driver alternately apply the sustaining pulse for causing the sustaining discharge of said selected discharge cells to the first electrode.

19. The driving apparatus as claimed in claim 17, wherein each of the first and third electrode drivers includes an energy recovery circuit for recovering an energy from the electrodes of said panel to charge the electrodes of said panel using the recovered voltage.

20. The driving apparatus as claimed in claim 17, wherein the third electrode driver includes:

a set-down driver for applying a negative set-down signal with a ramp waveform to the third electrode in a reset interval for initializing the entire field;

a scanning driver for applying any one of a positive direct current voltage and a ground voltage to the third electrode in accordance with said sub-fields in the address interval;

a sustaining driver for applying sustaining pulses having a different pulse width to the third electrode in the sustaining interval; and a ramp driver being driven when the following sub-field is the selective writing sub-field to apply a ramp waveform at the last time of the sustaining interval.

21. The driving apparatus as claimed in claim 17, wherein the third electrode driver further includes:

a reset driver for successively applying a negative rectangular pulse to the third electrode in a reset interval for initializing the entire field.

22. The driving apparatus as claimed in claim 17, wherein, if the following sub-field is a sub-field selecting the cells by a writing discharge in the address interval, the first and third electrode drivers alternately apply a pulse having a pulse width within 1$\mu$m to the first and third electrodes at the end time of the sustaining interval.

23. The driving apparatus as claimed in claim 17, wherein a falling edge of a sum voltage signal applied to the first and third electrode is stepwise changed in a reset interval for initializing the entire field.

24. The driving apparatus as claimed in claim 16, wherein the first electrode driver includes:

a setup driver for applying a positive setup signal with a ramp waveform to the first electrode in a reset interval for initializing the entire field;

a set-down driver for applying a negative set-down signal with a ramp waveform to the first electrode after an application of the positive setup signal; and a sustaining driver for applying sustaining pulses having a different pulse width to the first electrode in the sustaining interval.

25. The driving apparatus as claimed in claim 16, wherein the first electrode driver further includes:

a reset driver for successively applying a negative rectangular pulse and a second positive setup signal after an application of a first positive setup signal having a ramp signal in a reset interval for initializing the entire field.

26. The driving apparatus as claimed in claim 16, wherein the first electrode driver sets a reference voltage of the first scanning pulse and a reference voltage of the second scanning pulse differently.

27. The driving apparatus as claimed in claim 16, wherein, if the following sub-field is a sub-field selecting the cells by a erasure discharge in the address interval, the first electrode driver applies a pulse having a larger pulse width than a normal sustaining pulse to the first electrode at the end time of the sustaining interval.

28. The driving apparatus as claimed in claim 16, wherein, if the following sub-field is a sub-field selecting the cells by a erasure discharge in the address interval, the first electrode driver applies a pulse having a larger voltage level than a normal sustaining pulse to the first electrode at the end time of the sustaining interval.

29. The driving apparatus as claimed in claim 16, wherein, if the following sub-field is a sub-field selecting the cells by a erasure discharge in the address interval, the first electrode driver applies a pulse having a larger pulse width and a larger voltage level than a normal sustaining pulse to the first electrode at the end time of the sustaining interval.

30. The driving apparatus as claimed in claim 16, wherein the first-scanning pulse is set to have a pulse width of 1 to 3 $\mu$s.

31. The driving apparatus as claimed in claim 16, wherein the second scanning pulse is set to have a pulse width within 1.5 $\mu$s.

32. A method of driving a plasma display panel, the method comprising:

providing at least one selective writing sub-field for addressing cells to be turned on by causing in each cell a writing address discharge for charging the cell; and providing at least one selective erasing sub-field for addressing cells to be turned off by causing in each cell an erasing address discharge for erasing charges remaining in the cell, wherein one frame period includes the at least one selective writing sub-field and the at least one selective erasing sub-field.

33. The method as claimed in claim 32, wherein the selective writing sub-field is arranged prior to the selective erasing sub-field.

34. The method as claimed in claim 32, wherein the selective erasing sub-field is arranged between two selective writing sub-fields.

35. The method as claimed in claim 32, wherein the selective writing sub-field comprises:

a first selective writing sub-field including a reset period for initializing a predetermined number of cells, a writing address period for addressing a cell to be turned on, a sustain period for causing sustaining discharge of the cells to be turned on, and an erasure period for erasing charges remaining in the cells;

a last selective writing sub-field, arranged just prior to the selective erasing sub-field, including the writing address period and the sustain period; and at least one middle selective writing sub-field, arranged between the first selective writing sub-field and the last selective writing sub-field, including the writing address period, the sustain period, and the erasure period.

36. The method as claimed in claim 35, wherein the middle selective writing sub-field and the last selective writing sub-field further comprise the reset period arranged just prior to the writing address period, respectively.

37. The method as claimed in claim 35, wherein the writing address period and the erasure period are equal to each other every selective writing sub-field, and the sustain period is set differently depending on a brightness weighting value assigned to the corresponding selective writing sub-field.

38. The method as claimed in claim 32, wherein the selective erasing sub-field comprises:

an erasing address period for addressing the cells to be turned off; and a sustain period for causing sustaining discharge of remaining cells excluding the cells addressed in the erasing address period.

39. The method as claimed in claim 38, wherein the sustaining period is set equally every selective erasing sub-field.

40. The method as claimed in claim 38, wherein the sustain period is set differently depending on a brightness weighting value assigned to the selective erasing sub-field.

41. The method as claimed in claim 32, wherein a sub-field arranged just prior to the selective writing sub-field includes the erasure period for erasing charges remaining in cells by the sustaining discharge.

42. The method as claimed in claim 32, wherein a sub-field arranged just prior to the selective erasing sub-field omits the erasure period for erasing charges remaining in cells by the sustaining discharge.

43. The method as claimed in claim 32, wherein gray level values are expressed by a combination of the selective writing sub-field and the selective erasing sub-field, and wherein a portion of the gray level values is expressed by at least one of a Dithering technique and an error diffusion technique.

44. The method as claimed in claim 32, further comprising:

applying a scanning voltage for selecting a scanning line of the cells being addressed to a scanning electrode of the plasma display panel; and applying a data voltage for addressing the cells to an address electrode of the plasma display panel.

45. The method as claimed in claim 44, further comprising steps of:

applying a predetermined direct current (DC) voltage to a sustaining electrode of the plasma display panel during the address period in which the cells are addressed; and applying sustaining pulses to the sustaining electrode during the sustain period for causing sustaining discharge of the addressed cells.

46. The method as claimed in claim 45, wherein the sustaining pulses are applied alternately to the scanning electrode and the sustaining electrode.

47. The method as claimed in claim 46, wherein in the selective writing sub-field, a first scanning pulse is applied to the scanning electrode, second to (n−1)th (n is a positive integer) scanning pulses are alternately applied to the sustaining electrode and the scanning electrode, and a last (nth) scanning pulse is applied to the scanning electrode, and wherein, in the selective erasing sub-field, a first scanning pulse is applied to the sustaining electrode, second to (n−1)th scanning pulses are alternately applied to the scanning electrode and the sustaining electrode, and a last (nth) scanning pulse is applied to the scanning electrode.

48. The method as claimed in claim 47, wherein at least one of pulse width and voltage level of the first sustaining pulse is larger than those of subsequent sustaining pulse.

49. The method as claimed in claim 44, wherein the scanning voltage in the selective writing sub-field and the scanning voltage in the selective erasing sub-field are different from each other.

50. The method as claimed in claim 49, wherein the scanning voltage in the selective writing sub-field and the scanning voltage in the selective erasing sub-field are different from each other in at least one of their pulse width arid voltage level.

51. The method as claimed in claim 45, wherein the DC voltage applied to the sustaining electrode in the address period of the selective writing sub-field is different in voltage level from that in the selective erasing sub-field.

52. The method as claimed in claim 45, wherein if the selective writing sub-field comes next, at least one of the scanning electrode and the sustaining electrode is provided with at least one erasure signal for erasing charges generated by the sustaining discharge.

53. The method as claimed in claim 47, wherein at least one of pulse width and voltage level of the last nth sustaining pulse is larger than those of previous sustaining pulse.

54. A frame for driving a plasma display panel, comprising:

a first group of sub-fields including at least one sub-field addressing randomly cells; and a second group of sub-fields including at least one sub-field addressing a desired cell among the addressed cells, wherein the first group of sub-fields addresses cells to be turned on by causing writing discharge for charging the cells, wherein the second group of sub-fields addresses cells to be turned off by causing erasing discharge for erasing charges remaining in the cells, and wherein none of the sub-fields in the second group of sub-fields addresses cells by causing a writing discharge.

55. The method as claimed in claim 54, wherein the first group of sub-fields addresses cells using a binary coding, and the second group of sub-fields addresses cells using a linear coding.

56. The frame as claimed in claim 54, wherein the first group of sub-fields determines a range of low gray level.

57. The frame as claimed in claim 54, wherein the second group of sub-fields determines a range of high gray level.

58. The frame of claim 54, wherein the sub-fields in the first group and the second group alternate within the frame.

59. A method of driving a plasma display panel, the method comprising:

providing a kth (k is a positive integer) frame including at least one selective writing sub-field for addressing cells to be turned on by causing in the cells writing discharge for charging the cells, and at least one selective erasing sub-field for addressing cells to be turned off by causing in the cells erasing discharge for erasing charges remaining in the cells; and providing a (k+1)th frame including at least one selective writing sub-field and at least one selective erasing sub-field and having brightness weighting values of the sub-fields different from those of kth frame.

60. The method as claimed in claim 59, wherein the brightness weighting values is set differently in the selective writing sub-fields of the kth frame and the (k-t-l)th frame.

61. A driving apparatus for a plasma display panel displaying an image by dividing one frame into a plurality of sub-fields, the apparatus comprising:

a data driver for selecting a first data for addressing cells to be turned on and a second data for addressing cells to be turned off depending on the sub-fields, and for supplying the selected first and second data to an address electrode of the plasma display panel; and a scanning driver for selecting a first scanning pulse for selecting a scanning line of the addressed cells to be turned on and a second scanning pulse for selecting a scanning line of the addressed cells to be turned off depending on the sub-fields, and for supplying the selected first and second scanning pulse to a scanning electrode of the plasma display panel.

62. The driving apparatus as claimed in claim 61, the apparatus further comprising:

a sustaining driver for supplying a predetermined DC voltage to a sustaining electrode of the plasma display panel in an address period for addressing the cells, and for supplying sustaining pulse to the sustaining electrode in a sustain period for causing sustaining discharge of the addressed cells.

63. The driving apparatus as claimed in claim 62, wherein the scanning driver and the sustaining driver is operated alternately, and the scanning driver supplies the sustaining pulses to the scanning electrode.

64. The driving apparatus as claimed in claim 63, wherein the scanning driver and the sustaining driver control a first sustaining pulse generated firstly in the sustain period differently from that of a normal sustaining pulse.

65. The driving apparatus as claimed in claim 61, wherein the scanning driver includes:

a set-up driver for applying a positive set-up signal with a ramp waveform to the scanning electrode in a reset period for initializing all cell;

a set-down driver for applying a set-down signal with a ramp waveform to the scanning electrode after an application of the positive set-up signal; and a sustaining driver for applying sustaining pulses having a different pulse width from each other to the scanning electrode in the sustain period.

66. The driving apparatus as claimed in claim 61, wherein voltage levels of the fist scanning pulse and the second scanning pulse are set differently from each other.

67. The driving apparatus as claimed in claim 61, wherein the scanning driver controls a last sustaining pulse being applied at the end time of the sustain period differently from that of a normal sustaining pulse.

68. The driving apparatus as claimed in claim 67, wherein the scanning driver controls any one of pulse width and voltage level of pulse being applied at the end time of the sustain period differently from that of the normal sustaining pulse when the following sub-field is a sub-field for addressing cells to be turned off.

69. The driving apparatus as claimed in claim 62, wherein the scanning driver and the sustaining driver includes an energy recovery circuit for recovering energy from the plasma display panel and charging the plasma display panel using the recovered energy.

70. The driving apparatus as claimed in claim 62, wherein the sustaining driver includes:

a scanning driver for applying any one of a positive DC voltage and a ground voltage to the sustaining electrode depending on the sub-fields in the address period;

a sustaining driver for applying sustaining pulses having a different pulse width from each other to the sustaining electrode in the sustain period; and a ramp driver, driven when the selective writing sub-field comes to next, for applying an erasing ramp waveform at the end time of the sustain period.

71. The driving apparatus as claimed in claim 62, wherein a railing edge of a sum voltages signal applied to the scanning electrode and the sustaining electrode is stepwise changed in a reset period for initializing all cells.

72. The driving apparatus as claimed in claim 63, wherein the scanning driver and the sustaining driver control any one of pulse width and voltage level of the first sustaining pulse differently from that of a normal sustaining pulse.

73. A driving apparatus for a plasma display panel, the apparatus comprising:

a selective writing driver for generating first data for addressing cells to be turned on and a first scanning voltage for selecting a scanning line of the cells to be turned on; and a selective erasing driver for generating second data for addressing cells to be turned off and a second scanning voltage for selecting a scanning line of the cells to be turned off, wherein the selective erasing driver does not generate a signal for performing a selective writing operation.

74. A frame for driving a plasma display panel, comprising:

a first group of sub-fields including at least one sub-field addressing randomly cells; and a second group of sub-fields including at least one sub-field addressing a desired cell among the addressed cells, wherein the first group of sub-fields addresses cells using a first type of coding and the second group of sub-fields addresses cells using a second type of coding.

75. The frame of claim 74, wherein the first type of coding is binary coding.

76. The frame of claim 74, wherein the first type of coding is linear coding.

77. The frame of claim 74, wherein the first group of sub-fields addresses cells using a binary coding and the second group of sub-fields addresses cells using a linear coding.

78. The frame as claimed in claim 77, wherein the first group of sub-fields determines a range of low gray level.

79. The frame as claimed in claim 77, wherein the second group of sub-fields determines a range of high gray level.

80. The frame as claimed in claim 77, wherein values included in the first group of sub-fields and the second group of sub-fields are combined to express a gray level value included in at least a portion of a picture displayed on the plasma display panel.

* * * * *